US009914308B2

(12) United States Patent
Yamada et al.

(10) Patent No.: US 9,914,308 B2
(45) Date of Patent: Mar. 13, 2018

(54) LIQUID EJECTION APPARATUS AND LIQUID EJECTION HEAD

(71) Applicant: CANON KABUSHIKI KAISHA, Tokyo (JP)

(72) Inventors: Kazuhiro Yamada, Yokohama (JP); Takatsuna Aoki, Yokohama (JP); Seiichiro Karita, Saitama (JP); Shuzo Iwanaga, Kawasaki (JP); Akio Saito, Machida (JP); Shingo Okushima, Kawasaki (JP); Zentaro Tamenaga, Sagamihara (JP); Yumi Komamiya, Kawasaki (JP); Noriyasu Nagai, Tokyo (JP); Tatsurou Mori, Yokohama (JP); Akira Yamamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/387,340

(22) Filed: Dec. 21, 2016

(65) Prior Publication Data

US 2017/0197432 A1 Jul. 13, 2017

(30) Foreign Application Priority Data

Jan. 8, 2016 (JP) ..... 2016-002943
Dec. 14, 2016 (JP) ..... 2016-242636

(51) Int. Cl.
*B41J 2/175* (2006.01)
*B41J 2/18* (2006.01)

(52) U.S. Cl.
CPC ..... *B41J 2/18* (2013.01); *B41J 2/17596* (2013.01); *B41J 2202/12* (2013.01)

(58) Field of Classification Search
CPC ..... B41J 2/18; B41J 2/17596; B41J 2202/12
See application file for complete search history.

(56) References Cited

U.S. PATENT DOCUMENTS 4,737,801 A 4/1988 Ichihashi et al. ..... 347/85
4,748,459 A 5/1988 Ichihashi et al. ..... 347/31
(Continued)

FOREIGN PATENT DOCUMENTS

JP 03606282 B2 4/2011
WO WO 03/041964 5/2003

OTHER PUBLICATIONS

U.S. Appl. No. 15/382,027, filed Dec. 16, 2016.
(Continued)

*Primary Examiner* — Juanita D Jackson
(74) *Attorney, Agent, or Firm* — Fitzpatrick, Cella, Harper & Scinto

(57) ABSTRACT

A liquid ejection apparatus of the invention is a liquid ejection apparatus including a liquid storage container that stores liquid, a circulation mechanism that circulates liquid in a circulation path, and a liquid ejection head fluidly-connected to the liquid storage container, the liquid ejection head having a plurality of ejection openings, wherein the liquid ejection head includes at least a pair of common passages and a plurality of individual passages that connect one of the pair of common passages to the other one of the pair of common passages and communicate with the plurality of ejection openings, respectively, and at least a pair of pressure adjustment mechanisms whose pressures are set to different control pressures is connected to respective upstream sides or downstream sides of the pair of common passages.

20 Claims, 33 Drawing Sheets

(56) References Cited

U.S. PATENT DOCUMENTS

| | | | | |
|---|---|---|---|---|
| 4,896,172 | A | 1/1990 | Nozawa et al. | 347/17 |
| 4,908,636 | A | 3/1990 | Saito et al. | 347/25 |
| 5,051,759 | A | 9/1991 | Karita et al. | 347/87 |
| 5,155,502 | A | 10/1992 | Kimura et al. | 347/87 |
| 5,166,707 | A | 11/1992 | Watanabe et al. | 347/3 |
| 5,189,443 | A | 2/1993 | Arashima et al. | 347/63 |
| 5,216,446 | A | 6/1993 | Satoi et al. | 347/65 |
| 5,237,342 | A | 8/1993 | Saikawa et al. | 347/87 |
| 5,251,040 | A | 10/1993 | Saito | 358/296 |
| 5,280,299 | A | 1/1994 | Saikawa et al. | 347/87 |
| 5,291,215 | A | 3/1994 | Nozawa et al. | 347/18 |
| 5,329,304 | A | 7/1994 | Koizumi et al. | 347/7 |
| 5,471,230 | A | 11/1995 | Saito et al. | 347/29 |
| 5,481,283 | A | 1/1996 | Watanabe et al. | 347/33 |
| 5,481,290 | A | 1/1996 | Watanabe et al. | 347/104 |
| 5,483,267 | A | 1/1996 | Nemura et al. | 347/32 |
| 5,488,395 | A | 1/1996 | Takayanagi et al. | 347/7 |
| 5,500,666 | A | 3/1996 | Hattori et al. | 347/87 |
| 5,502,479 | A | 3/1996 | Ishinaga et al. | 347/93 |
| 5,515,091 | A | 5/1996 | Kimura et al. | 347/86 |
| 5,548,309 | A | 8/1996 | Okubo et al. | 347/33 |
| 5,559,536 | A | 9/1996 | Saito et al. | 347/25 |
| 5,619,238 | A | 4/1997 | Higuma et al. | 347/86 |
| 5,623,287 | A | 4/1997 | Saikawa et al. | 347/47 |
| 5,629,728 | A | 5/1997 | Karita et al. | 347/87 |
| 5,689,290 | A | 11/1997 | Saito et al. | 347/7 |
| 5,703,632 | A | 12/1997 | Arashima et al. | 347/47 |
| 5,757,399 | A | 5/1998 | Murayama et al. | 347/32 |
| 5,864,352 | A | 1/1999 | Aoki et al. | 347/102 |
| 5,917,514 | A | 6/1999 | Higuma et al. | 347/29 |
| 5,917,524 | A | 6/1999 | Kimura et al. | 347/86 |
| 6,012,795 | A | 1/2000 | Saito et al. | 347/7 |
| 6,048,045 | A | 4/2000 | Nohata et al. | 347/7 |
| 6,056,386 | A | 5/2000 | Nohata et al. | 347/19 |
| 6,123,420 | A | 9/2000 | Higuma et al. | 347/86 |
| 6,247,784 | B1 | 6/2001 | Obana et al. | 347/37 |
| 6,250,752 | B1 | 6/2001 | Tajima et al. | 347/92 |
| 6,286,945 | B1 | 9/2001 | Higuma et al. | 347/86 |
| 6,290,344 | B1 | 9/2001 | Saikawa et al. | 347/86 |
| 6,332,673 | B1 | 12/2001 | Higuma et al. | 347/86 |
| 6,382,786 | B2 | 5/2002 | Iwanaga et al. | 347/86 |
| 6,406,118 | B1 | 6/2002 | Aoki et al. | 347/16 |
| 6,419,341 | B1 | 7/2002 | Nohata et al. | 347/19 |
| 6,419,349 | B1 | 7/2002 | Iwanaga et al. | 347/86 |
| 6,474,801 | B2 | 11/2002 | Higuma et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,688,735 | B2 | 2/2004 | Higuma et al. | 347/86 |
| 6,742,881 | B2 | 6/2004 | Kotaki et al. | 347/86 |
| 6,796,643 | B2 | 9/2004 | Higuma et al. | 347/85 |
| 7,156,507 | B2 | 1/2007 | Aruga et al. | 347/85 |
| 7,922,312 | B2 | 4/2011 | Haines et al. | 347/93 |
| 9,315,041 | B2 | 4/2016 | Moriguchi et al. | B41J 2/18 |
| 9,327,513 | B2 | 5/2016 | Moriguchi et al. | B41J 2/175 |
| 9,358,803 | B2 | 6/2016 | Moriguchi et al. | B41J 2/175 |
| 2002/0113853 | A1 | 8/2002 | Hattori et al. | 347/86 |
| 2003/0043241 | A1 | 3/2003 | Hattori et al. | 347/86 |
| 2012/0200649 | A1* | 8/2012 | Igawa | B41J 2/175 347/89 |
| 2013/0169710 | A1 | 7/2013 | Keefe et al. | 347/17 |

OTHER PUBLICATIONS

U.S. Appl. No. 15/387,334, filed Dec. 21, 2016.
U.S. Appl. No. 15/382,039, filed Dec. 16, 2016.
U.S. Appl. No. 15/382,048, filed Dec. 16, 2016.
U.S. Appl. No. 15/380,584, filed Dec. 15, 2016.

* cited by examiner

LIQUID EJECTION APPARATUS AND LIQUID EJECTION HEAD

BACKGROUND OF THE INVENTION

Field of the Invention

The present invention relates to a liquid ejection apparatus that performs printing on a printing medium by ejecting liquid. More specifically, the invention relates a circulation-type liquid ejection apparatus that circulates ink between a liquid storage container and a liquid ejection head, and the liquid ejection head mounted therein.

Description of the Related Art

There is a known circulation-type liquid ejection apparatus, which circulates ink between a liquid storage container and a liquid ejection head, represented by an inkjet printing apparatus. A line-type (page wide type) liquid ejection head in which a plurality of print element boards are disposed across a page width is mounted in a circulation-type liquid ejection apparatus corresponding to an example of the known circulation-type liquid ejection apparatus.

In such a liquid ejection apparatus, a pressure difference may be generated in a pressure applied to ink adjacent to each ejection opening in some cases. For example, a large amount of ink is supplied to an elongated liquid ejection head developed for commercial printing, and thus a pressure difference is easily generated around each ejection opening depending on printing duties. In addition, for example, in the circulation-type liquid ejection apparatus, a pressure variation generated when a circulation pump pulses may affect a pressure difference around each ejection opening in some cases. When printing is performed in a state in which an influence of the pressure difference is generated around each ejection opening, the volume of ink drops ejected from each ejection opening is non-uniform, which causes unevenness in density in a printed image to degrade an image quality.

Meanwhile, recently, a head has been proposed as a measure against bubbles in a passage or a measure against an influence on ejection due to thickening of ink around an ejection opening. The head has a form in which an ink supply path and an ink collection path are provided inside the liquid ejection head, and a pressure difference is generated between the supply path and the collection path, thereby generating an ink flow passing through an ejection opening. For example, US Patent Laid-Open No. 2013/0169710 proposes a liquid ejection apparatus that controls an ink supply path and an ink collection path such that the paths have different pressures using a plurality of pressure control mechanisms. The liquid ejection apparatus of US Patent Laid-Open No. 2013/0169710 may maintain a pressure applied to ink around each ejection opening within a certain range while circulating ink inside the liquid ejection head using a differential pressure generated between the ink supply path and the ink collection path.

SUMMARY OF THE INVENTION

An liquid ejection apparatus of the invention is a liquid ejection apparatus including a liquid storage container that stores liquid, a circulation mechanism that circulates liquid in a circulation path, and a liquid ejection head fluidly-connected to the liquid storage container, the liquid ejection head having a plurality of ejection openings, wherein the liquid ejection head includes at least a pair of common passages and a plurality of individual passages that connect one of the pair of common passages to the other one of the pair of common passages and communicate with the plurality of ejection openings, respectively, and at least a pair of pressure adjustment mechanisms whose pressures are set to different control pressures is connected to respective upstream sides or downstream sides of the pair of common passages.

Further features of the present invention will become apparent from the following description of exemplary embodiments (with reference to the attached drawings).

DESCRIPTION OF THE EMBODIMENTS

Figure 1:
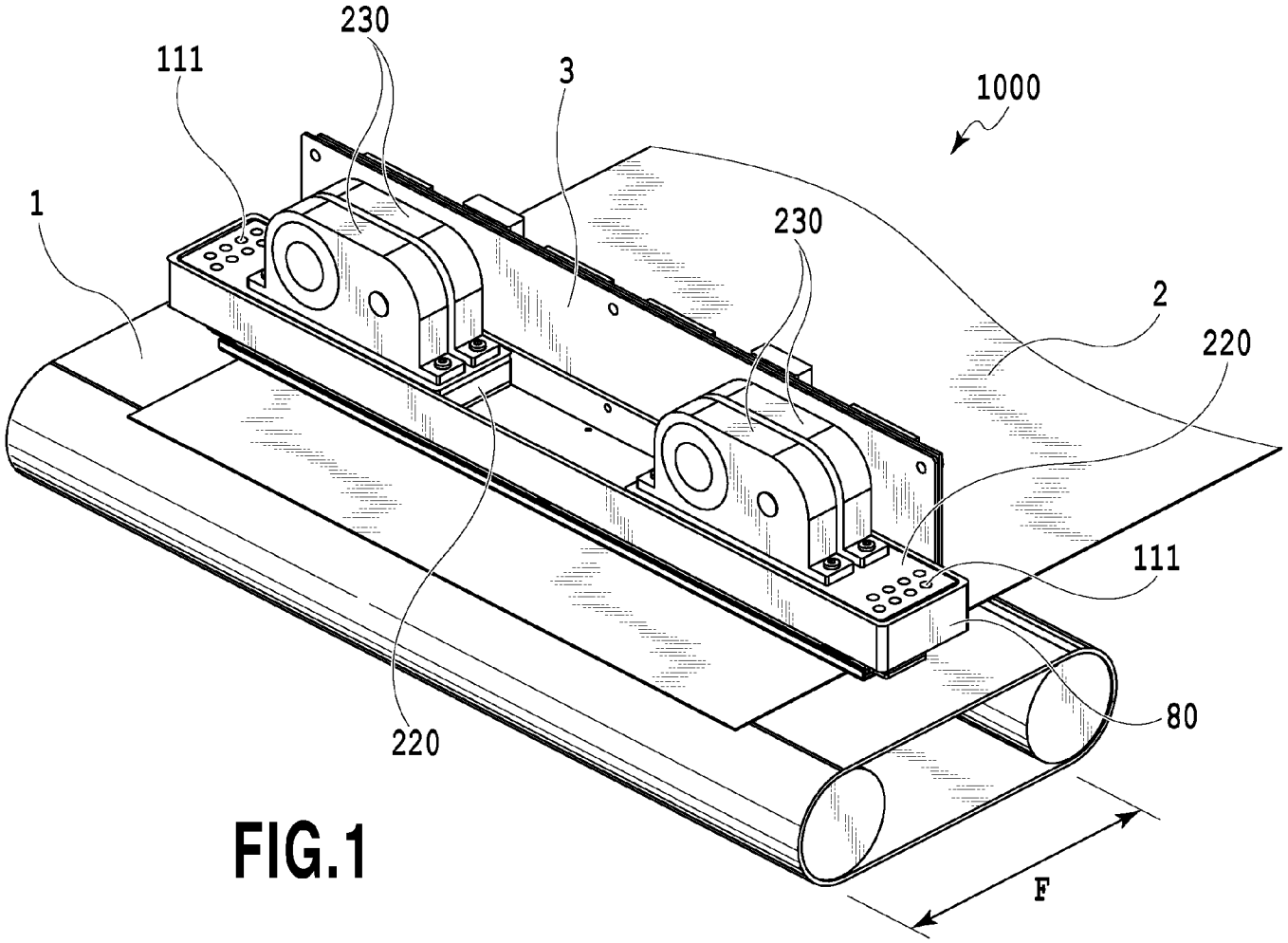
FIG. 1 is a diagram illustrating a schematic configuration of a liquid ejection apparatus that ejects a liquid.

A configuration of the liquid ejection apparatus described in US Patent Laid-Open No. 2013/0169710 has a problem that a circulation flow rate inside the print element board varies or stops by an influence of ejection of ink from the head. For example, when the circulation flow rate is set to be lower than a maximal value of an ejection flow rate, there is a problem that a printing duty increases and the circulation flow rate decreases or stops.

In addition, in the liquid ejection apparatus described in US Patent Laid-Open No. 2013/0169710, a set of pressure adjustment mechanisms are connected in parallel to a plurality of print element boards. Thus, for example, when all print element boards except for one print element board perform high-duty printing, there occurs a problem that a circulation flow rate within the inactive print element board decreases or stops. This problem is avoided when the set of pressure adjustment mechanisms are independently connected to each of the print element boards, respectively. However, a lot of pressure control mechanisms are necessary for one head, and cost of the head rises.

When the circulation flow rate inside the print element board is set to be sufficiently larger than the maximal value of the ejection flow rate, the variation of the circulation flow rate due to the above-described ejection state may be relatively decreased. However, in particular, in a head using a print element having a thermal type, a piezo type using shear mode, etc. in which heat generation involved with ejection is large, a rate of exhaust heat from a chip increases when the circulation flow rate is set to be large, and a large cooler is needed in a circulation path. Thus, there occurs a problem of an increase in cost of a main body of a printer or an increase in cooling power.

Hereinafter, a description will be given of respective embodiments and respective modified examples of the invention with reference to drawings. A liquid ejection head of the invention which ejects liquid such as ink and a liquid ejection apparatus mounted with the liquid ejection head are applicable to devices such as a printer, a copy machine, a facsimile having a communication system, a word processor having a printer unit, etc. Further, the liquid ejection head and the liquid ejection apparatus are applicable to an industrial print device complexly combined with various processors. Examples of use may include manufacture of a biochip, print of an electronic circuit, manufacture of a semiconductor substrate, etc.

In addition, the respective embodiments and the respective modified examples described below are suitable specific examples of the invention, and thus various technically preferable restrictions are imposed thereon. However, the present application examples and embodiments are not limited to application examples, embodiments, and other specific methods of this specification as long as the present application examples and embodiments conform to a technical idea of the invention.

Embodiment 1

(Description of Liquid Ejection Apparatus)

FIG. 1 is a diagram illustrating a schematic configuration of a liquid ejection apparatus that ejects a recording liquid (hereinafter, also referred to as a liquid) in the invention and particularly a liquid ejection apparatus (hereinafter, also referred to as a printing apparatus) 1000 that prints an image by ejecting ink. The liquid ejection apparatus 1000 includes a conveying unit 1 which conveys a print medium 2 and a line type (page wide type) liquid ejection head 3 which is disposed to be substantially orthogonal to the conveying direction of the print medium 2. Then, the liquid ejection apparatus 1000 is a line type printing apparatus which continuously prints an image at one pass by ejecting ink onto the relative moving print mediums 2 while continuously or intermittently conveying the print mediums 2. The liquid ejection head 3 includes a pressure control unit 230 which controls pressures (a negative pressure and a positive pressure) inside a circulation path, a liquid supply unit 220 which communicates with the pressure control unit 230 so that a fluid can flow therebetween, a liquid connection portion 111 which serves as an ink supply opening and an ink discharge opening of the liquid supply unit 220, and a casing 80. The print medium 2 is not limited to a cut sheet and may be also a continuous roll medium. The liquid ejection head 3 can print a full color image by inks of cyan C, magenta M, yellow Y, and black K and is fluid-connected to a liquid supply member, a main tank, and a buffer tank (see FIG. 2 to be described later) which serve as a supply path supplying a liquid to the liquid ejection head 3. Further, the control unit which supplies power and transmits an ejection control signal to the liquid ejection head 3 is electrically connected to the liquid ejection head 3. The liquid path and the electric signal path in the liquid ejection head 3 will be described later.

The liquid ejection apparatus 1000 is an liquid ejection apparatus that circulates a liquid such as ink between a tank to be described later and the liquid ejection head 3. The circulation configuration includes a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head 3. Hereinafter, the first circulation configuration and the second circulation configuration of the circulation will be described.

(Description of First Circulation Configuration)

Figure 2:
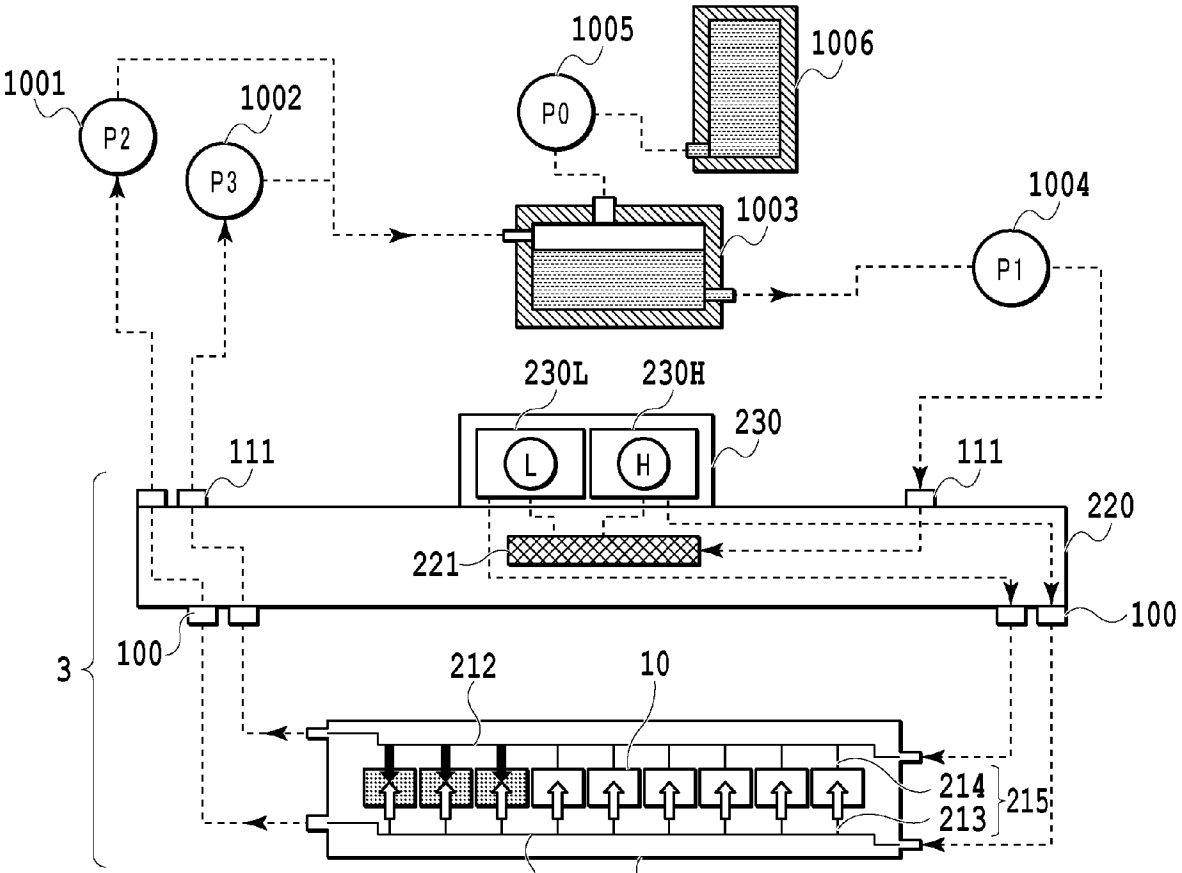
FIG. 2 is a schematic diagram illustrating a first circulation configuration in a circulation path applied to a printing apparatus.

FIG. 2 is a schematic diagram illustrating the first circulation configuration in the circulation path applied to the liquid ejection apparatus 1000 of the present embodiment. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the liquid ejection apparatus body.

In the first circulation configuration, ink stored in the main tank 1006 is supplied to the buffer tank 1003 by a replenishing pump 1005, and then supplied to the liquid supply unit 220 of the liquid ejection head 3 through the liquid connection portion 111 by a second circulation pump 1004. In the present embodiment, the main tank 1006 and the buffer tank 1003 correspond to a liquid storage container that stores a print liquid. Thereafter, ink adjusted to two different pressures (high pressure and low pressure) by the pressure control unit 230 connected to the liquid supply unit 220 circulates by being divided into two passages on the high pressure side and the low pressure side. In the present embodiment, a description will be given of a mode in which the pressure control unit 230 controls two different negative pressures. However, in a modified example described below, a description will be given of a mode in which the pressure control unit 230 controls a positive pressure and a negative pressure. Ink inside the liquid ejection head 3 circulates inside the liquid ejection head by actions of the first circulation pump (high pressure side) 1001 and the first circulation pump (low pressure side) 1002 in a downstream side of the liquid ejection head 3, and returns to the buffer tank 1003 by being discharged from the liquid ejection head 3. In the present embodiment, the first circulation pumps 1001 and 1002, a second circulation pump 1004, and the pressure control unit 230 correspond to a circulation mechanism in the first circulation configuration.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. Also, in order to ensure a predetermined flow rate, a control circuit that controls the number of revolutions of the pump based on the output value of the flow rate sensor provided in the circulation path may be used. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality. Above all, when a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The pressure control unit 230 is provided in a path between the second circulation pump 1004 and the liquid ejection unit 300. The pressure control unit 230 is operated to keep a pressure at the downstream side (that is, a pressure near the liquid ejection unit 300) of the pressure control unit 230 at a predetermined pressure even when the flow rate of the ink changes in the circulation system due to a difference in ejection amount per unit area. As two pressure control mechanisms constituting the pressure control unit 230, any mechanism may be used as long as a pressure at the downstream side of the pressure control unit 230 can be controlled within a predetermined range or less from a desired set pressure. As an example, a mechanism such as so-called "a pressure reduction valve and a pressure reduction regulator" can be employed. In the circulation passage of the application example, the upstream side of the pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the liquid ejection apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the pressure control unit 230 can be also used instead of the second circulation pump 1004. As illustrated in FIG. 2, the pressure control unit 230 includes two pressure adjustment mechanisms respectively having different control pressures. In the two pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220. The liquid ejection unit 300 is provided with the common supply passage 211, the common collection passage 212, and an individual passage 215 (an individual supply passage 213 and an individual collection passage 214) communicating with each print element board. The pressure adjustment mechanism H is connected to the common supply passage 211, the pressure adjustment mechanism L is connected to the common collection passage 212, and a differential pressure is formed between the two common passages. Then, the individual passage 215 is connected to the common supply passage 211 corresponding to one of a pair of common passages and the common collection passage 212 corresponding to the other one of the pair of common passages, and communicates with an ejection opening 13 of the print element board 10. According to this configuration, a flow (an arrow direction of FIG. 2) is generated in which a part of the liquid flows from the common supply passage 211 to the common collection passage 212 through a passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign substance in the ink can be discharged toward the common collection passage 212. For this reason, the liquid ejection head 3 of the application example can print a high-quality image at a high speed.

(Description of Second Circulation Configuration)

Figure 3:
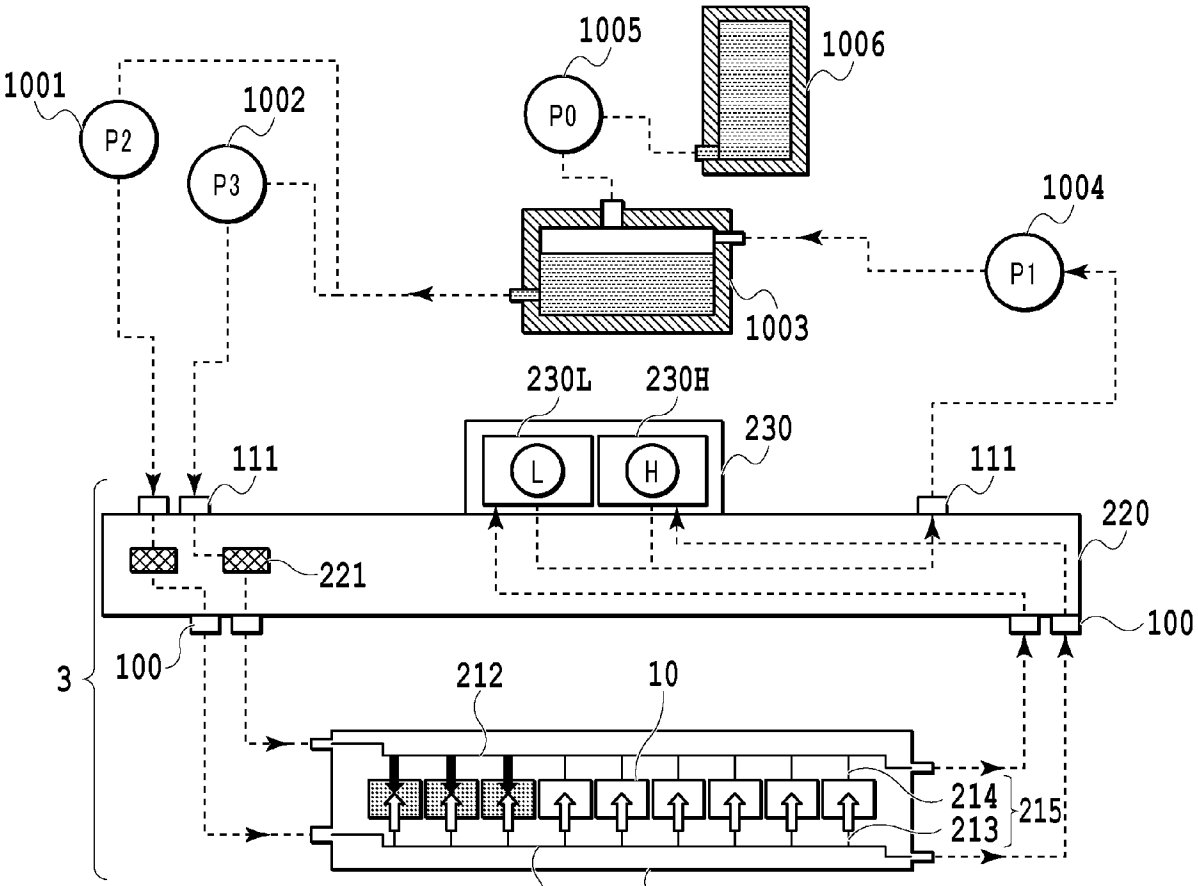
FIG. 3 is a schematic diagram illustrating a second circulation configuration in the circulation path applied to the liquid ejection apparatus.

FIG. 3 is a schematic diagram illustrating the second circulation configuration which is a circulation configuration different from the first circulation configuration in the circulation path applied to the liquid ejection apparatus of the application example. A main difference from the first circulation configuration is that two negative pressure control mechanisms constituting the pressure control unit 230 both control a pressure at the upstream side of the pressure control unit 230 within a predetermined range from a desired set pressure. Further, another difference from the first circulation configuration is that the second circulation pump 1004 serves as a negative pressure source which reduces a pressure at the downstream side of the pressure control unit 230. Further, still another difference is that the first circulation pump (the high pressure side) 1001 and the first circulation pump (the low pressure side) 1002 are disposed at the upstream side of the liquid ejection head 3 and the pressure control unit 230 is disposed at the downstream side of the liquid ejection head 3.

In the second circulation configuration, the ink inside the main tank 1006 is supplied to the buffer tank 1003 by the replenishing pump 1005. Subsequently, the ink is divided into two passages and is circulated in two passages at the high pressure side and the low pressure side by the action of the pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the pressure control unit 230. The discharged ink is returned to the buffer tank 1003 by the second circulation pump 1004. In the present embodiment, the first circulation pump 1001, 1002, the second circulation pump 1004, and the pressure control unit 230 correspond to a circulation mechanism in the second circulation configuration.

In the second circulation configuration, the pressure control unit 230 stabilizes a pressure variation at an upstream side (that is, the liquid ejection unit 300 side) of the pressure control unit 230 within a certain range around a preset pressure even when the flow rate changes due to a change in ejection amount per unit area. As the two pressure adjustment mechanism included in the pressure control unit 230, any pressure adjustment mechanism may be used as long as a pressure at the upstream side of the pressure control unit 230 can be controlled to change within a certain range or less from a desired control pressure. As an example, a back pressure mechanism referred to as a so-called "back pressure valve/back pressure regulator" can be employed. In the circulation passage of the present embodiment, a downstream side of the pressure control unit 230 is pressurized by the second circulation pump 1004 through the liquid supply unit 220. With such a configuration, since an influence of a water head pressure of the buffer tank 1003 on the liquid ejection head 3 can be suppressed, a range of selection of layout of the buffer tank 1003 in the liquid ejection apparatus 1000 can be widened. For example, a water head tank disposed to have a certain water head difference with respect to the pressure control unit 230 can be also used instead of the second circulation pump 1004. The pressure control unit 230 includes two pressure adjustment mechanisms respectively having different control pressures. In the two pressure adjustment mechanisms, a high pressure side (indicated by "230H" in FIG. 3) and a low pressure side (indicated by "230L" in FIG. 3) are respectively connected to the common supply passage 211 and the common collection passage 212 inside the liquid ejection unit 300 through the liquid supply unit 220. When a pressure in the common supply passage 211 is set to be relatively higher than a pressure in the common collection passage 212 using the two pressure adjustment mechanisms, an ink flow is generated to flow from the common supply passage 211 to the common collection passage 212 through the individual passage 215 and the passage formed inside each print element board 10.

In such a second circulation configuration, the same ink flow as that in the first circulation configuration is obtained inside the liquid ejection unit 300, but has two advantages different from those in the first circulation configuration. As a first advantage, a foreign substance or a trash entering the pressure control unit 230 is prevented from flowing into the liquid ejection head 3. In other words, in the second circulation configuration, the pressure control unit 230 is disposed at the downstream side of the liquid ejection head 3, and a filter 221 described below is disposed at the upstream side of the liquid ejection head 3. For this reason, the foreign substance entering the pressure control unit 230 may be removed from the liquid and prevented from flowing into the liquid ejection head 3 when ink is circulated in the circulation path by operating the first circulation pumps 1001 and 1002 and the second circulation pump 1004. In second circulation configuration, a pressure adjustment unit is disposed at the downstream side of the liquid ejection head 3. Therefore, even when a foreign substance enters the circulation path by opening and closing a valve included in the pressure adjustment mechanism, the entering foreign substance is removed by the filter 221 before arriving at the liquid ejection head 3. As a second advantage, in the second circulation configuration, a maximal value of a necessary rate of a flow supplied from the liquid from the buffer tank 1003 to the liquid ejection head 3 is smaller than that in the first circulation configuration. The reason is as below.

In the case of the circulation in the print standby state, the sum of the flow rates of the common supply passage 211, the common collection passage 212 and individual passages 215 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening×the ejection frequency per unit time×the number of the ejection openings).

Figure 4:
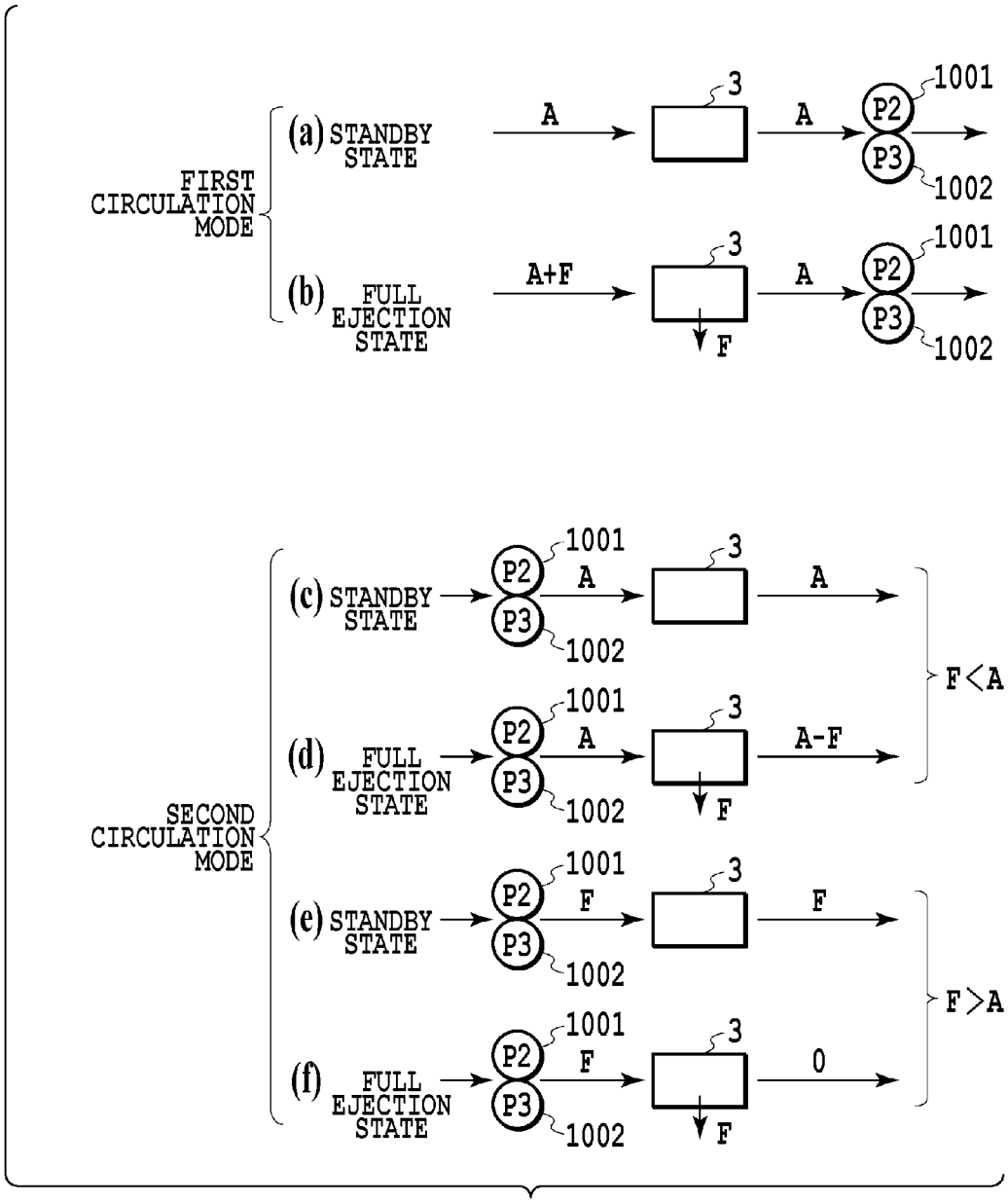
FIG. 4 is a schematic diagram illustrating a difference in ink inflow amount to a liquid ejection head.

FIG. 4 is a schematic diagram illustrating a difference in ink inflow amount to the liquid ejection head between the first circulation configuration and the second circulation configuration. A reference character (a) illustrates the standby state in the first circulation configuration and a reference character (b) illustrates the full ejection state in the first circulation configuration. Reference characters (c) to (f) illustrate the second circulation passage. Here, reference characters (c) and (d) illustrate a case where the flow rate F is lower than the flow rate A and reference characters (e) and (f) illustrate a case where the flow rate F is higher than the flow rate A. In this way, the flow rates in the standby state and the full ejection state are illustrated.

In the case of the first circulation configuration (reference characters (a) and (b)) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes a flow rate A. By the flow rate A, the temperature inside the liquid ejection unit 300 in the standby state can be managed. In addition, in the case of the full ejection state of the liquid ejection head 3, the total flow rate of the first circulation pump 1001 and the first circulation pump 1002 is the flow rate A as before. However, a negative pressure generated by ejection in the liquid ejection head 3 acts. For this reason, a maximal rate of the flow supplied to the liquid ejection head 3 is obtained such that a flow rate F consumed by the full ejection is added to the flow rate A of the total flow rate. Therefore, a maximal value of the supply amount to the liquid ejection head 3 satisfies a relation of the flow rate A+the flow rate F since the flow rate F is added to the flow rate A (the reference character (b)).

Herein, the case of the full ejection state is considered in which some print element boards 10 among a plurality of print element boards 10 are in a print standby state, and ink is ejected from all ejection openings 13 of the other print element boards 10 in the first circulation configuration (FIG. 2). A description will be given on the assumption that print element boards 10 indicated by halftone dot meshing among the print element boards 10 of the liquid ejection unit 300 correspond to print element boards 10 in the full ejection state, and print element boards 10 indicated by white space among the print element boards 10 correspond to print element boards 10 in the print standby state as illustrated in FIG. 2. In this instance, in addition to ink from the common supply passage 211 (a direction of a void arrow), a certain amount of ink from the common collection passage 212 (a direction of a black arrow) is supplied to the print element boards 10 in the full ejection state. Meanwhile, ink from the common supply passage 211 (a direction of a void arrow) is continuously supplied to the print element boards 10 in the print standby state. Since the amount of ink flowing into the liquid ejection unit 300 increases, a differential pressure between the common supply passage 211 and the common collection passage 212 slightly varies. However, an influence thereof may be ignored when a cross-sectional area of the common passage may be sufficiently ensured.

As described above, the first circulation configuration of the present embodiment has a configuration in which ink is supplied to the print element boards 10 in the print standby state when some print element boards 10 are in the print standby state, and the other print element boards 10 are in the full ejection state. According to this configuration, the amount of ink supplied to the liquid ejection head 3 may be suitably controlled. In other words, the differential pressure between the common passages may be controlled such that a flow rate of ink passing through individual passages 215 in the print element boards 10 in the print standby state is smaller than an ejection flow rate of ink ejected from all ejection openings 13 in the print element boards 10. When the differential pressure between the common supply passage 211 and the common collection passage 212 is controlled as described above, the amount of ink circulated in the print element boards 10 in the print standby state may be suppressed irrespective of a variation in ejection flow rate of ink from the ejection openings 13 of the liquid ejection head 3. When the amount of ink circulated in the print element boards 10 in the print standby state may be suppressed, exhaust heat from the liquid ejection head 3 may be suppressed, and a cooling mechanism, etc. for cooling ink inside the circulation passage may be simplified.

Meanwhile, in the case of the second circulation configuration ((c) to (f)) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation configuration. Thus, when the flow rate A is higher than the flow rate F ((c) and (d)) in the second circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (d). However, when the flow rate F is higher than the flow rate A ((e) and (f)), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (f). In addition, if the liquid is not ejected in the full ejection state when the flow rate F is higher than the flow rate A, the liquid which is attracted by the amount consumed by the ejection of the flow rate F is discharged from the liquid ejection head 3.

As described above, in the case of the second circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation configuration becomes smaller than the maximal value (the flow rate A+the flow rate F) of the supply flow rate necessary for the first circulation configuration. The second circulation configuration of the present embodiment is configured such that, when some print element boards 10 are in the print standby state, and the other print element boards 10 are in the full ejection state, ink is supplied to the print element boards 10 in the print standby state. The second circulation configuration is similar to the first circulation configuration in that the amount of ink circulated in the print element boards 10 in the print standby state is suppressed irrespective of a variation in ejection flow rate of ink from the ejection openings 13 of the liquid ejection head 3 by controlling the differential pressure between the common supply passage 211 and the common collection passage 212.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the liquid ejection apparatus can be decreased. This advantage is high in the line head having a relatively large value of the flow rate A or the flow rate F. Accordingly, a line head having a long longitudinal length among the line heads is beneficial.

Meanwhile, the first circulation configuration is more advantageous than the second circulation configuration. That is, in the second circulation configuration, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink.

Meanwhile, in the case of the first circulation configuration, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation configurations can be desirably selected in consideration of the specifications (the ejection flow rate F, the minimal circulation flow rate A, and the passage resistance inside the head) of the liquid ejection head and the liquid ejection apparatus body.

(Description of Configuration of Liquid Ejection Head)

Figure 5A:
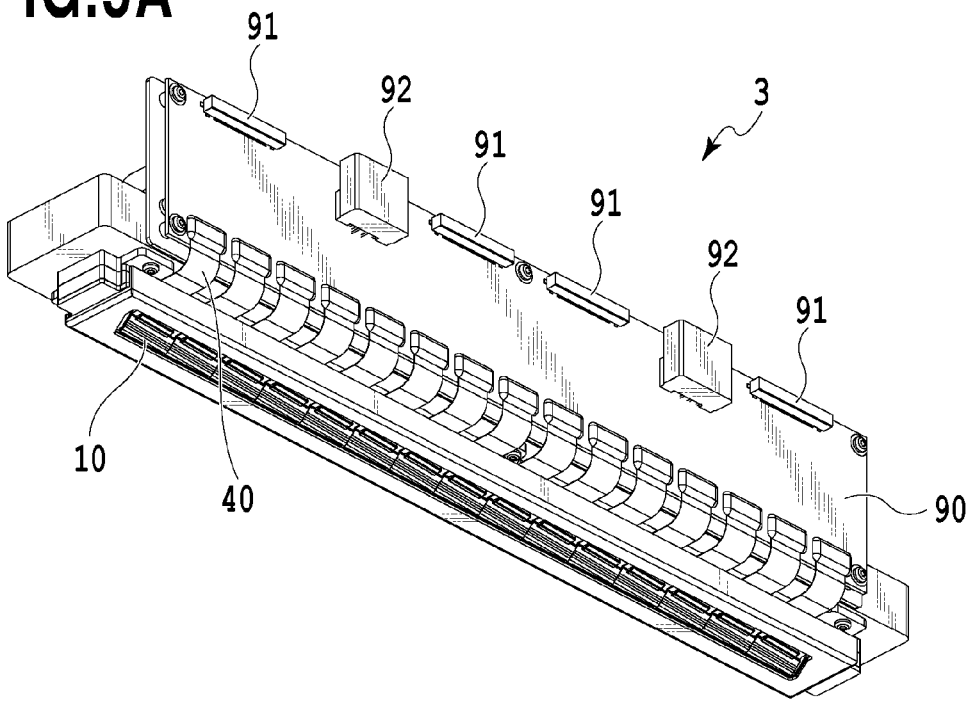
FIG. 5A is a perspective view illustrating the liquid ejection head.
Figure 5B:
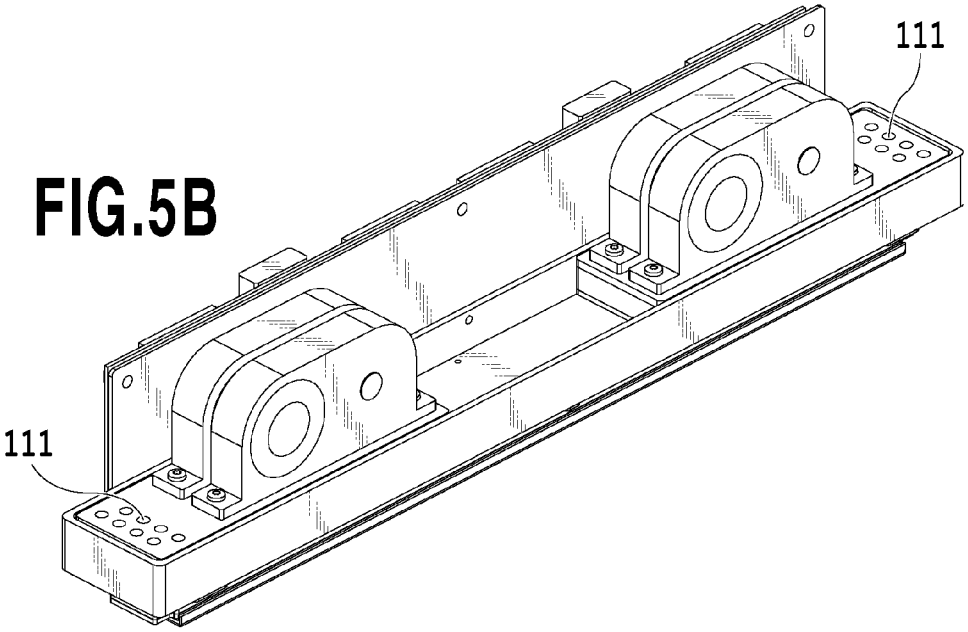
FIG. 5B is a perspective view illustrating the liquid ejection head.

A configuration of the liquid ejection head 3 according to the first embodiment will be described. FIGS. 5A and 5B are perspective views illustrating the liquid ejection head 3 according to the present embodiment. The liquid ejection head 3 is a line type liquid ejection head in which fifteen print element boards 10 capable of ejecting inks of four colors of cyan C, magenta M, yellow Y, and black K are arranged in a straight line shape on one print element board 10 (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10. The signal input terminal 91 and the power supply terminal 92 are electrically connected to the control unit of the liquid ejection apparatus 1000 so that an ejection drive signal and power necessary for the ejection are supplied to the print element board 10. When the wirings are integrated by the electric circuit inside the electric wiring board 90, the number of the signal input terminals 91 and the power supply terminals 92 can be decreased compared with the number of the print element boards 10. Accordingly, the number of electrical connection components to be separated when the liquid ejection head 3 is assembled to the liquid ejection apparatus 1000 or the liquid ejection head is replaced decreases. As illustrated in FIG. 5B, the liquid connection portions 111 which are provided at both ends of the liquid ejection head 3 are connected to the liquid supply system of the liquid ejection apparatus 1000. Accordingly, the inks of four colors including cyan C, magenta M, yellow Y, and black K4 are supplied from the supply system of the liquid ejection apparatus 1000 to the liquid ejection head 3 and the inks passing through the liquid ejection head 3 are collected by the supply system of the liquid ejection apparatus 1000. In this way, the inks of different colors can be circulated through the path of the liquid ejection apparatus 1000 and the path of the liquid ejection head 3.

Figure 6:
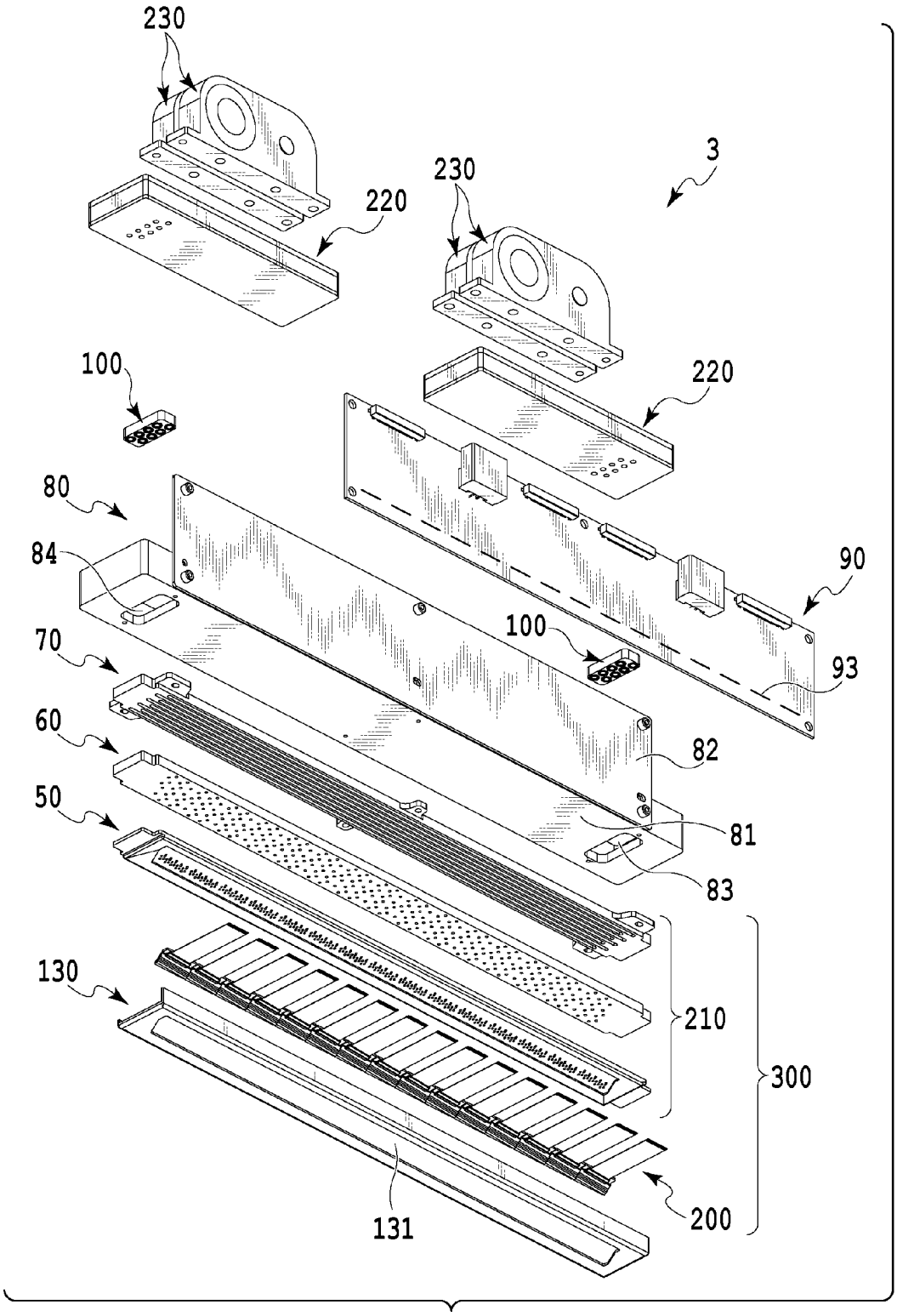
FIG. 6 is an exploded perspective view of the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign substance in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the pressure control unit 230 disposed on the liquid supply unit 220 disposed to correspond to each color. The pressure control unit 230 is a unit which includes different colors of pressure control valves. By the function of a spring member or a valve provided therein, a change in pressure loss inside the supply system (the supply system at the upstream side of the liquid ejection head 3) of the liquid ejection apparatus 1000 caused by a change in flow rate of the liquid is largely decreased. Accordingly, the pressure control unit 230 can stabilize a change negative pressure at the downstream side (the liquid ejection unit 300) of the pressure control unit within a predetermined range. As described in FIG. 2, two pressure control valves of different colors are built inside the pressure control unit 230. Two pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed. For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
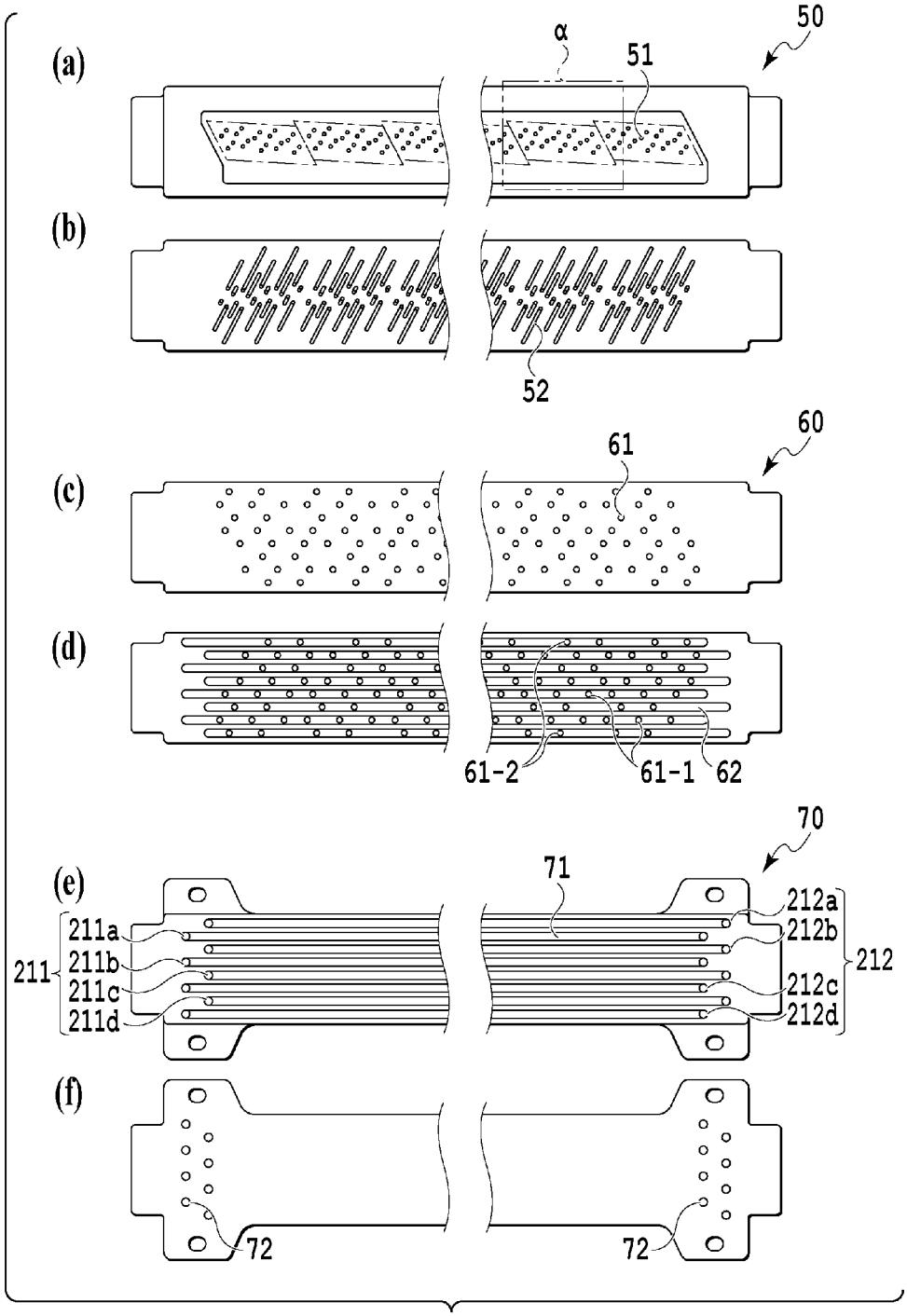
FIG. 7 is a diagram illustrating front and rear faces of first to third passage members.

FIG. 7 is a diagram illustrating front and rear faces of the first to third passage members. A reference character (a) illustrates a face onto which the ejection module 200 is mounted in the first passage member 50 and a reference character (f) illustrates a face with which the liquid ejection unit support portion 81 comes into contact in the third passage member 70. The first passage member and the second passage member 60 are bonded to teach other so that the parts illustrated in reference characters (b) and (C) and corresponding to the contact faces of the passage members face each other and the second passage member and the third passage member are bonded to each other so that the parts illustrated in reference characters (d) and (e) and corresponding to the contact faces of the passage members face each other. When the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members. Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see a reference character (f)) of the third passage member 70 communicates with the holes of the joint rubber 100 and is fluid-connected to the liquid supply unit 220 (see FIG. 6). A bottom face of the common passage groove 62 of the second passage member 60 is provided with a plurality of communication openings 61 (a communication opening 61-1 communicating with the common supply passage 211 and a communication opening 61-2 communicating with the common collection passage 212) and communicates with one end of an individual passage groove 52 of the first passage member 50. The other end of the individual passage groove 52 of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 8:
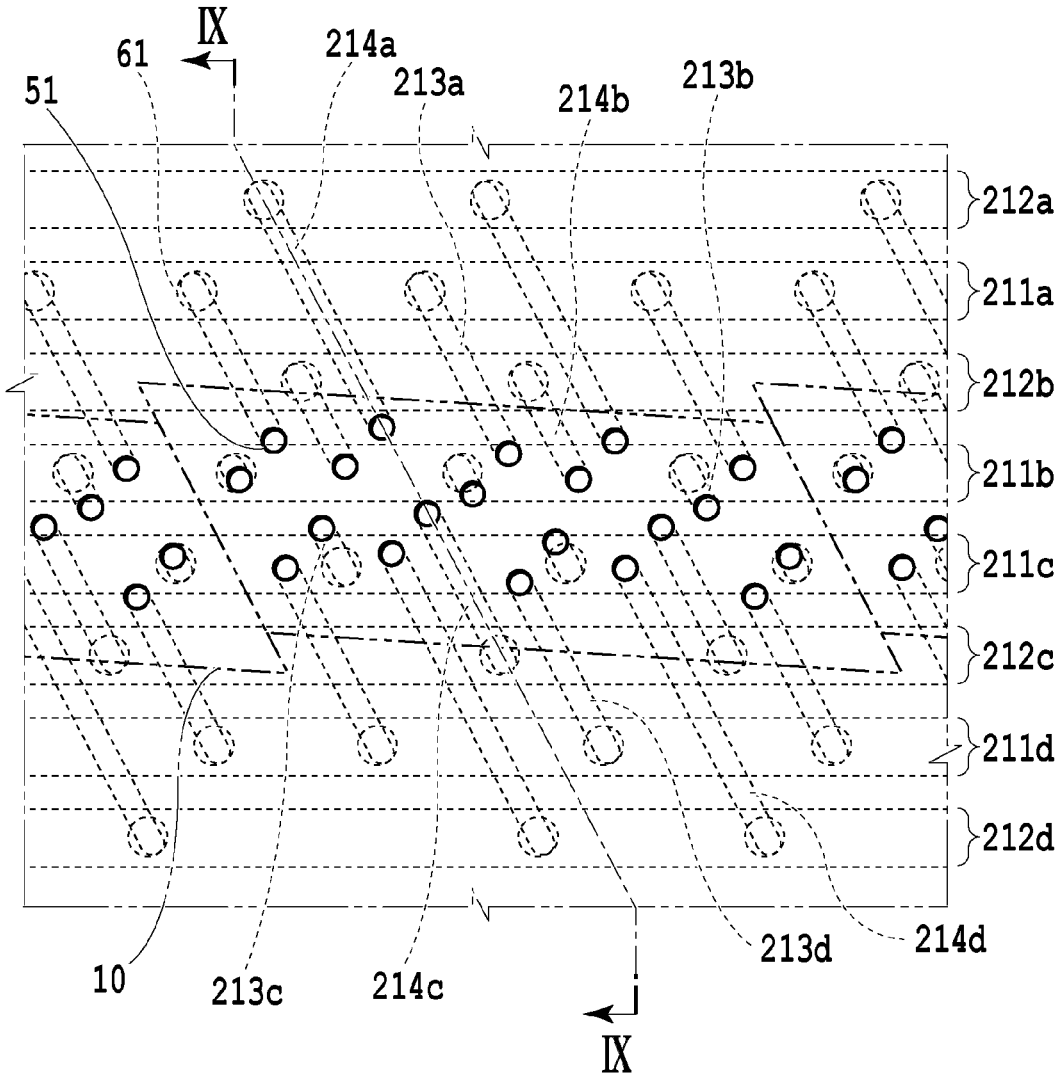
FIG. 8 is a perspective view of a part a of a reference character (a) in FIG. 7 when viewed from an ejection module mounting face.

FIG. 8 is a partially enlarged perspective view illustrating a part a of the reference character (a) in FIG. 7 and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
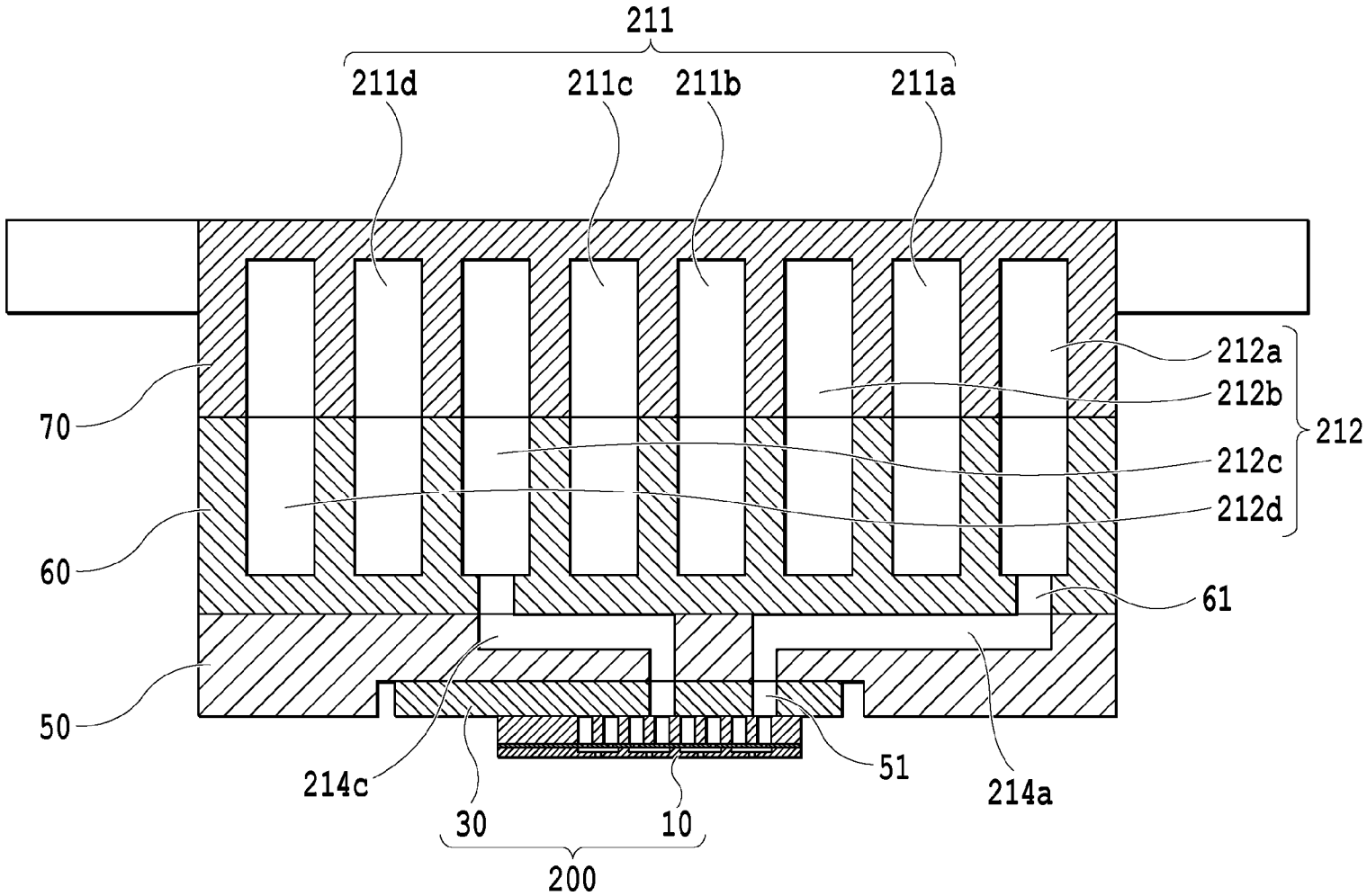
FIG. 9 is a cross-sectional view taken along a line IX-IX of FIG. 8.

FIG. 9 is a cross-sectional view taken along a line IX-IX of FIG. 8. The individual collection passage (214*a*, 214*c*)

communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the pressure control unit 230 (the high pressure side) of corresponding color through the liquid supply unit 220 and the common collection passage 212 is connected to the pressure control unit 230 (the low pressure side) through the liquid supply unit 220. By the pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the application example having the passages connected to one another.

(Description of Ejection Module)

Figure 10A:
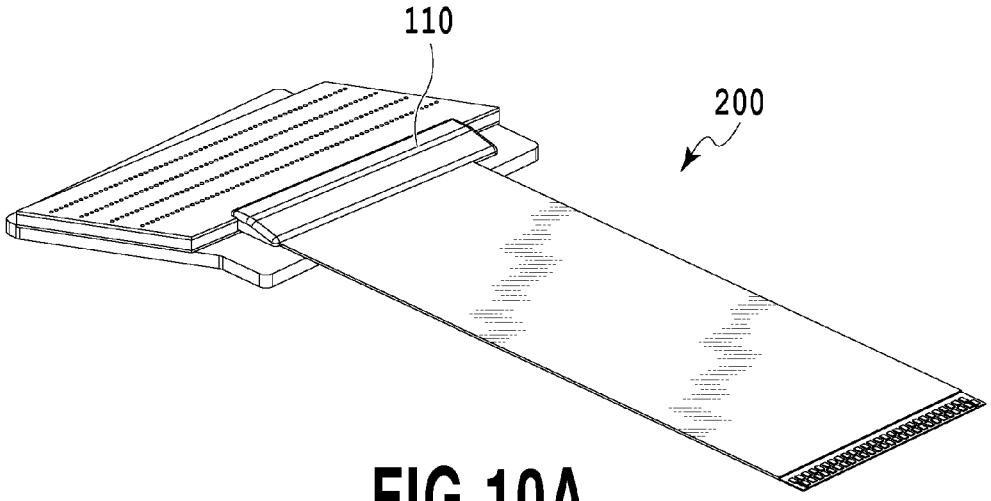
FIG. 10A is a perspective view illustrating one ejection module.
Figure 10B:
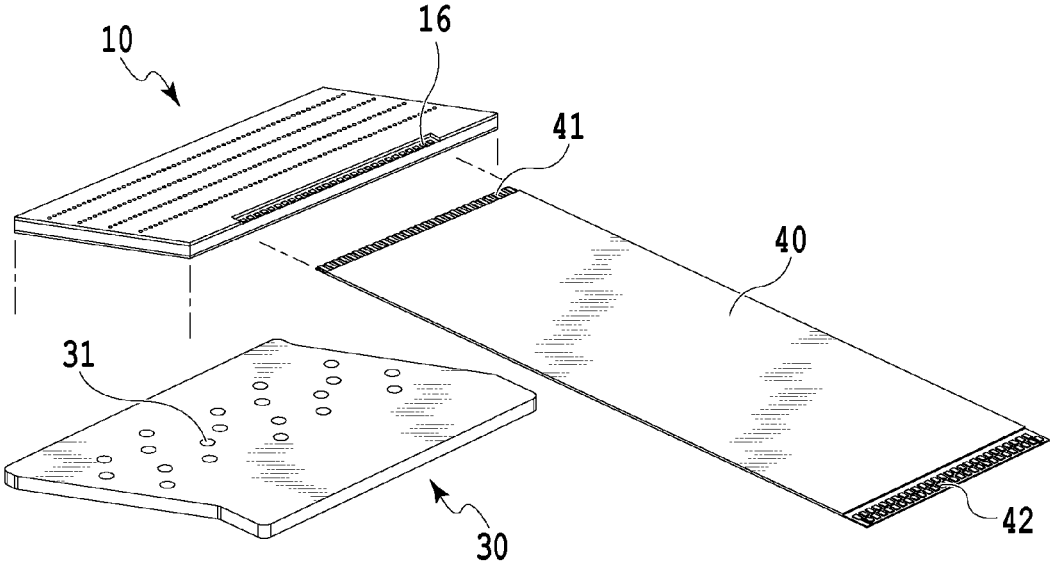
FIG. 10B is an exploded view illustrating one ejection module.

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110. A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
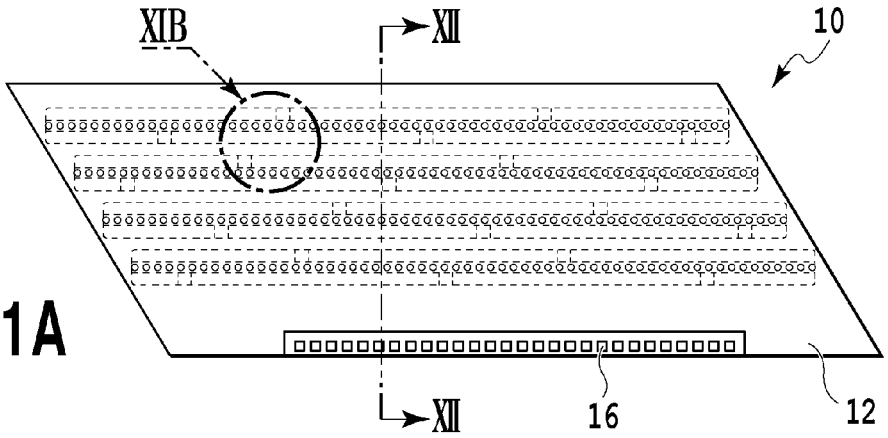
FIG. 11A is a diagram illustrating a print element board.
Figure 11B:
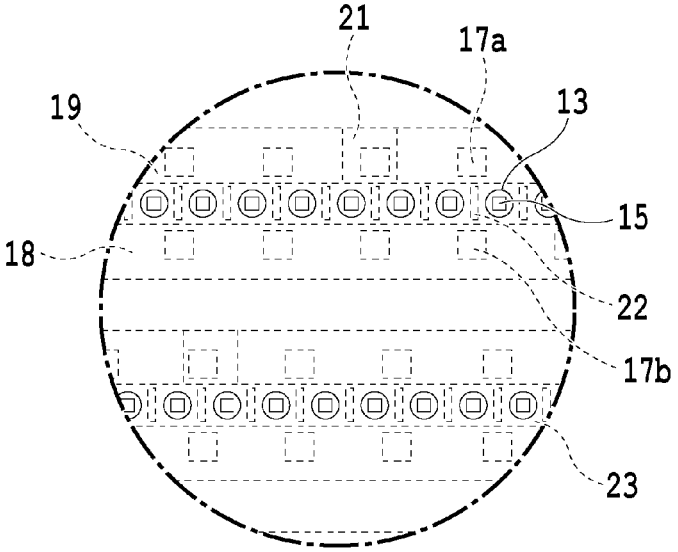
FIG. 11B is a diagram illustrating the print element board.
Figure 11C:
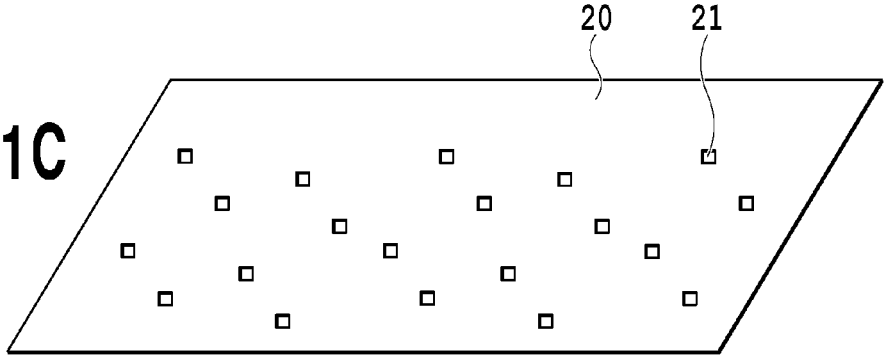
FIG. 11C is a diagram illustrating the print element board.

FIG. 11A is a top view illustrating a face provided with an ejection opening 13 in the print element board 10, FIG. 11B is an enlarged view of a part A of FIG. 11A, and FIG. 11C is a top view illustrating a rear face of FIG. 11A. Here, a configuration of the print element board of the application example will be described. As illustrated in FIG. 11A, an ejection opening forming member of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as an ejection energy generation element for ejecting the liquid by heat energy is disposed at a position corresponding to each ejection opening 13. A pressure chamber 23 provided inside the print element 15 is defined by a partition wall 22. The print element 15 is electrically connected to the terminal 16 by an electric wire (not illustrated) provided in the print element board 10. Then, the print element 15 boils the liquid while being heated on the basis of a pulse signal input from a control circuit of the liquid ejection apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped lid member 20 is laminated on a rear face of a face provided with the ejection opening 13 in the print element board 10 and the lid member 20 is provided with a plurality of openings 21 communicating with the liquid supply path 18 and the liquid collection path 19. In the application example, the lid member 20 is provided with three openings 21 for each liquid supply path 18 and two openings 21 for each liquid collection path 19. As illustrated in FIG. 11B, openings 21 of the lid member 20 communicate with the communication openings 51 illustrated in the reference character (a) in FIG. 7. It is desirable that the lid member 20 have sufficient corrosion resistance for the liquid. From the viewpoint of preventing mixed color, the opening shape and the opening position of the opening 21 need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member by a film-shaped member with a thin thickness in consideration of pressure loss.

Figure 12:
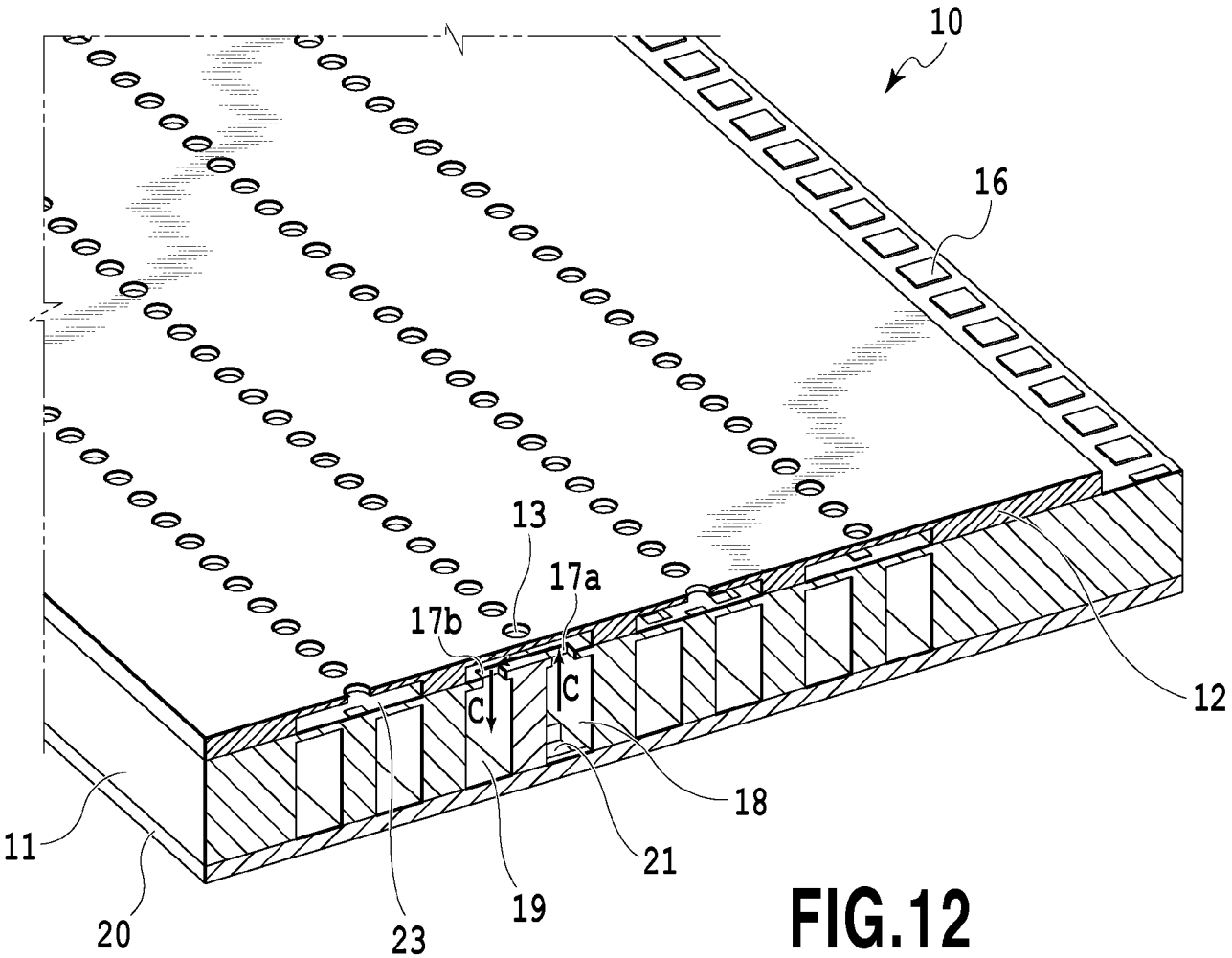
FIG. 12 is a perspective view illustrating cross-sections of the print element board and a lid member.

FIG. 12 is a perspective view illustrating cross-sections of the print element board 10 and the lid member 20 when taken along a line XII-XII of FIG. 11A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row. The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign substances, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed. The liquid which is collected to the liquid collection path 19 is collected in order of the communication opening 51 inside the passage member 210, the individual collection passage 214, and the common collection passage 212 through the opening 21 of the lid member 20 and the liquid communication opening 31 (see FIG. 10B) of the support member 30. That is, the liquid supplied from the liquid ejection apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11. In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the first circulation configuration illustrated in FIG. 2, the liquid which flows from the liquid connection portion 111 is supplied to the joint rubber 100 through the pressure control unit 230. Further, in the second circulation configuration illustrated in FIG. 3, the liquid which is collected from the pressure chamber 23 passes through the joint rubber 100 and flows from the liquid connection portion 111 to the outside of the liquid ejection head through the pressure control unit 230. The entire liquid which flows from one end of the common supply passage 211 of the liquid ejection unit 300 is not supplied to the pressure chamber 23 through the individual supply passage 213. That is, the liquid may flow from the other end of the common supply passage 211 to the liquid supply unit 220 while not flowing into the individual supply passage 213 by the liquid which flows from one end of the common supply passage 211. In this way, since the path is provided so that the liquid flows therethrough without passing through the print element board 10, the reverse flow of the circulation flow of the liquid can be suppressed even in the print element board 10 including the large passage with a small flow resistance as in the application example. In this way, since the thickening of the liquid in the vicinity of the ejection opening or the pressure chamber 23 can be suppressed in the liquid ejection head 3 of the application example, a slippage or a non-ejection can be suppressed. As a result, a high-quality image can be printed.

(Description of Positional Relation Among Print Element Boards)

Figure 13:
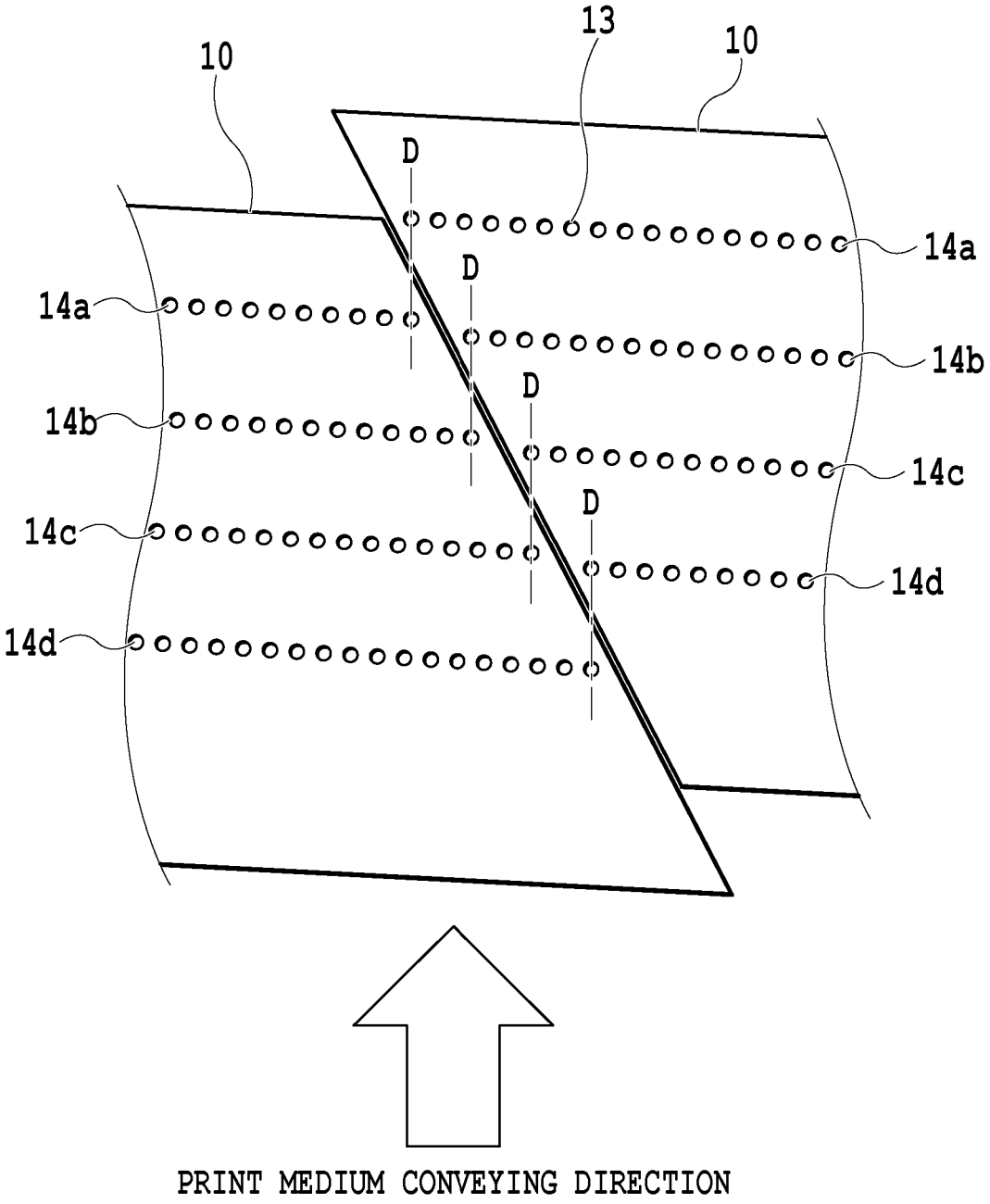
FIG. 13 is a partially enlarged top view of an adjacent portion of the print element board.

FIG. 13 is a partially enlarged top view illustrating an adjacent portion of the print element board in two adjacent ejection modules. In the application example, a substantially parallelogram print element board is used. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other. With such an arrangement, even when a position of the print element board 10 is slightly deviated from a predetermined position, black streaks or missing of a print image cannot be seen by a driving control of the overlapping ejection openings. Even when the print element boards 10 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 13. Further, in the application example, a principal plane of the print element board has a parallelogram shape, but the invention is not limited thereto. For example, even when the print element boards having a rectangular shape, a trapezoid shape, and the other shapes are used, the configuration of the invention can be desirably used.

(Description of Structure of Pressure Control Unit)

Figure 14A:
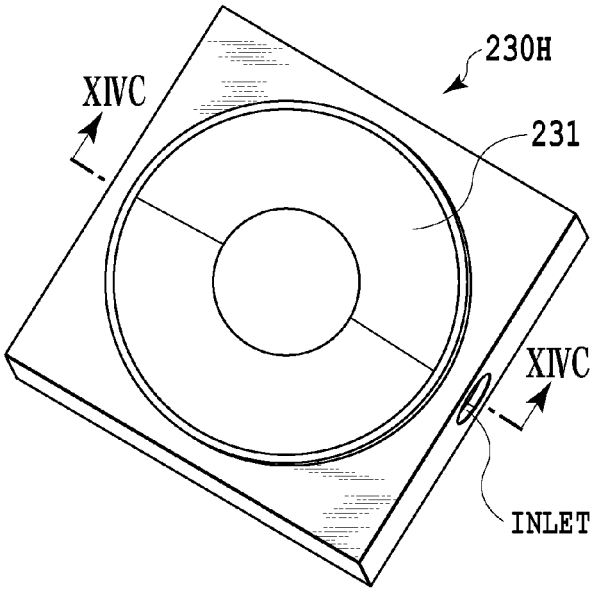
FIG. 14A is a diagram illustrating a pressure adjustment mechanism of a first circulation configuration.
Figure 14B:
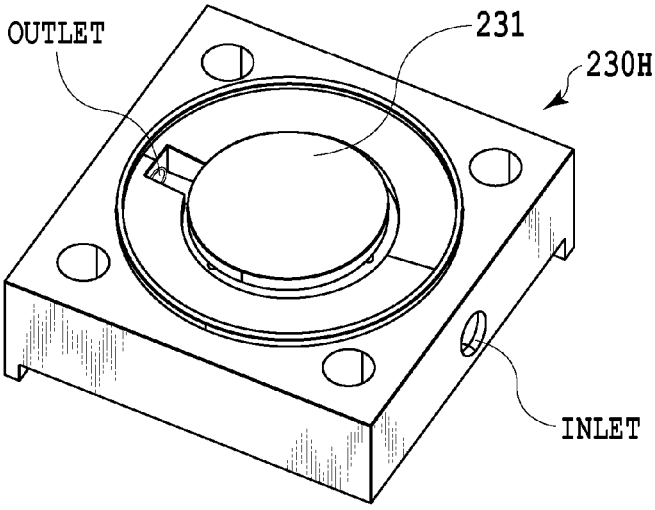
FIG. 14B is a diagram illustrating the pressure adjustment mechanism of the first circulation configuration.
Figure 14C:
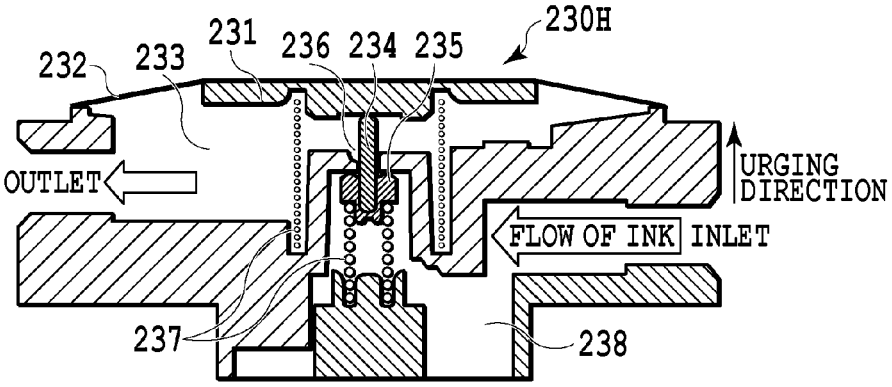
FIG. 14C is a diagram illustrating the pressure adjustment mechanism of the first circulation configuration.

FIG. 14A and FIG. 14B are external perspective views illustrating the pressure adjustment mechanism 230H (pressure reducing valve) of the pressure control unit 230 used in the first circulation configuration, and FIG. 14C is a cross-sectional view thereof. The pressure adjustment mechanism 230L on the low pressure side has the same configuration except that a control pressure (initial load of a spring) is different, and thus a description of the pressure adjustment mechanism 230L will be omitted. An operation principle of the pressure adjustment mechanism 230H in FIG. 14A to FIG. 14C is the same as that of a mechanism generally referred to as a "pressure reducing valve".

FIG. 14B illustrates a state in which a flexible film 232 is not illustrated such that the inside of the pressure adjustment mechanism 230H is easily viewed. FIG. 14C is a diagram illustrating a cross section taken along XIVC-XIVC line of FIG. 14A. As illustrated in FIG. 14B and FIG. 14C, the pressure adjustment mechanism 230H includes a pressure plate 231, a first pressure chamber 233 provided at a downstream side to which the liquid ejection head 3 is connected, and the flexible film 232 that fluidly seals the pressure plate 231 and the first pressure chamber 233. In the present embodiment, the pressure plate 231 is shifted depending on the increase or decrease in ink inside the first pressure chamber, and joined to the flexible film 232 corresponding to a flexible member. In addition, a second pressure chamber 238 provided on a upstream side to which the second circulation pump 1004 is connected, a valve 235 connected by the pressure plate 231 and a shift 234, and an orifice 236 fit to the valve 235 are present at an upstream side of the pressure chamber 233. The orifice 236 of the present embodiment is provided at a boundary between the first pressure chamber 233 and the second pressure chamber 238. The shift 234, the valve 235, and the pressure plate 231 need to be integrally moved, and are joined together using an adhesive, a fitting hole, etc. In addition, the pressure plate 231 and the valve 235 are urged by an urging member 237 (spring) in a direction in which the valve 235 is blocked.

In FIG. 14C, the valve 235 is provided at an upstream side of the orifice 236, and a gap between the orifice 236 and the valve 235 is reduced when the pressure plate 231 is moved upward. Ink entering from an inlet of the pressure adjustment mechanism 230H flows into the first pressure chamber 233 through the gap between the orifice 236 and the valve 235, and delivers a pressure thereof to the pressure plate 231. Thereafter, the ink is discharged to the liquid ejection head 3 from an outlet of the pressure adjustment mechanism 230H.

A pressure inside the first pressure chamber 233 is determined based on a relational expression below that indicates a balance of a force applied to each portion. P1 may be set to a desired control pressure by changing a force of the urging member 237. In the embodiment illustrated in FIG. 14C, the urging member 237 includes two linkage springs. However, when a composed spring force may satisfy a desired negative pressure value, pressure adjustment performance is not affected, and thus only one of the springs may be used. A constant K is changed, or a length of the urging member 237 at the time of operation is changed in order to change the force of the urging member 237.

$$P2=P0-(P1Sv+Kx)/Sd \qquad \text{Expression (1)}$$

Herein, values indicated by the respective parameters are as below.

Sd: area of pressure plate

Sv: pressure receiving area of valve

P0: atmospheric pressure

P1: pressure at upstream side of orifice

P2: pressure inside first pressure chamber

K: spring constant x: spring displacement

In Expression (1), the second term of the right side has a positive value at all times. Thus, an inequality of P2<P0 is satisfied, and P2 becomes a negative pressure.

In addition, when a flow resistance of a valve is set to R, and a rate of a flow passing through the inside of the pressure adjustment mechanism 230H is set to Q, an equation below is satisfied.

$$P2=P1-QR \qquad \text{Expression (2)}$$

Figure 15:
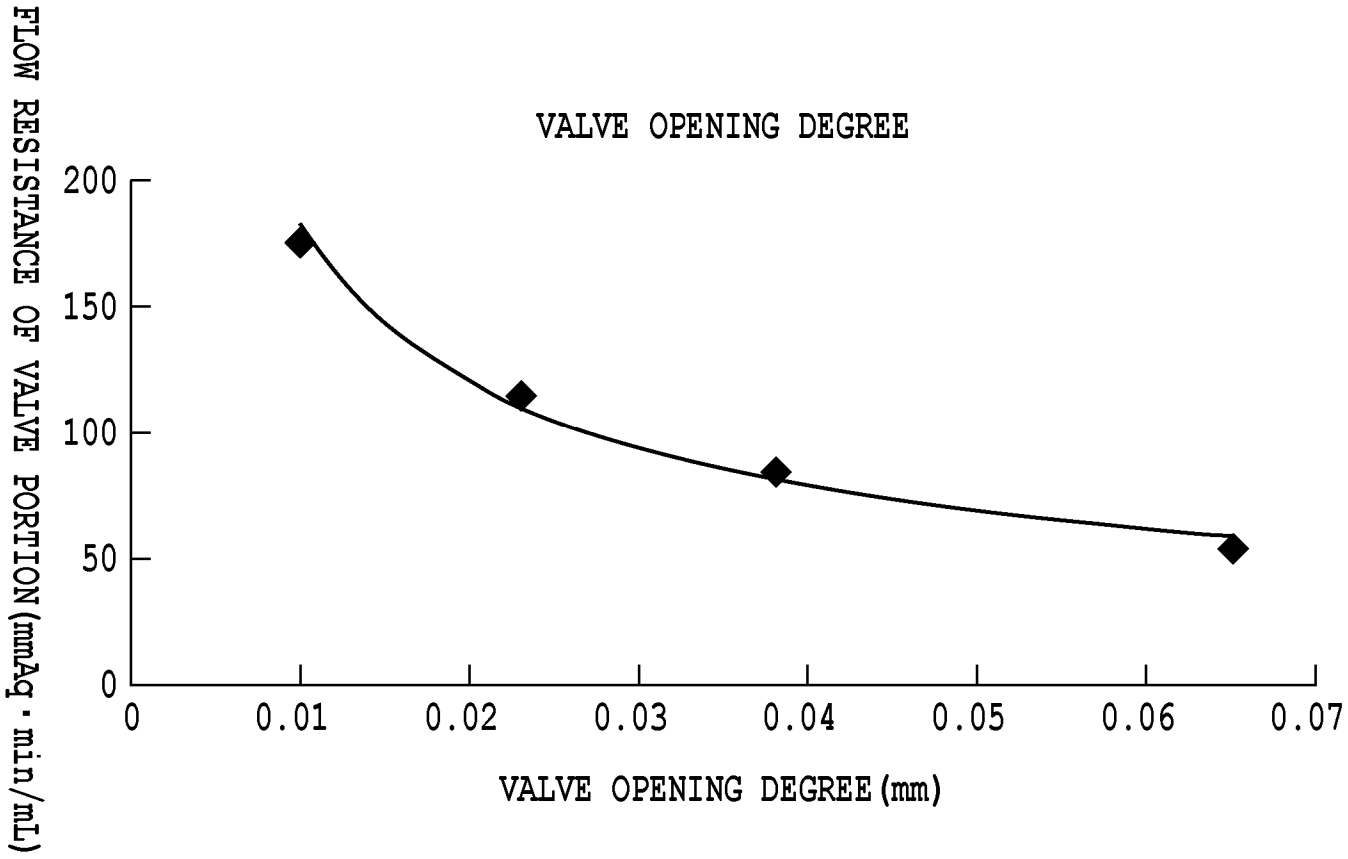
FIG. 15 is a diagram illustrating a relation between a flow resistance R and a valve opening degree.

Herein, for example, the flow resistance R and the valve opening degree of the valve 235 are designed to have a relation of FIG. 15. In more detail, the flow resistance R varies such that the flow resistance R decreases (increases) as the valve opening degree of the valve 235 increases (decreases). P2 is derived when a position of the valve 235 is determined such that Expression (1) and Expression (2) are simultaneously satisfied.

When a flow rate Q to the pressure control unit 230 increases, a pressure of a pressurization source connected to an upstream side of the pressure adjustment mechanism 230H is constant. Thus, P1 decreases by an increase of the flow resistance from the pressure adjustment mechanism 230H to the buffer tank 1003 due to an increase in flow rate. For this reason, a force P1Sv for opening the valve 235 decreases, and P2 instantaneously rises as in Expression (1).

In addition, R=(P1−P2)/Q is derived from Expression (2). Herein, since P2 increases, and P1 decreases, R decreases. When R decreases, the valve opening degree increases.

As illustrated in FIG. 14C, when the valve opening degree increases, the length of the urging member 237 decreases. Thus, x corresponding to displacement from a free length increases, and a force kx of the urging member 237 increases. For this reason, P2 instantaneously decreases from Expression (1). When P2 instantaneously increases, P2 instantaneously decreases by a reverse action. When this phenomenon is intermittently repeated in a short time, both Expression (1) and Expression (2) are satisfied while the valve opening degree changes depending on the flow rate Q. As a result, P2 is controlled at a constant value, and thus a pressure at the outlet side (downstream side) of the pressure adjustment mechanism 230H is controlled at a constant value.

Figure 16A:
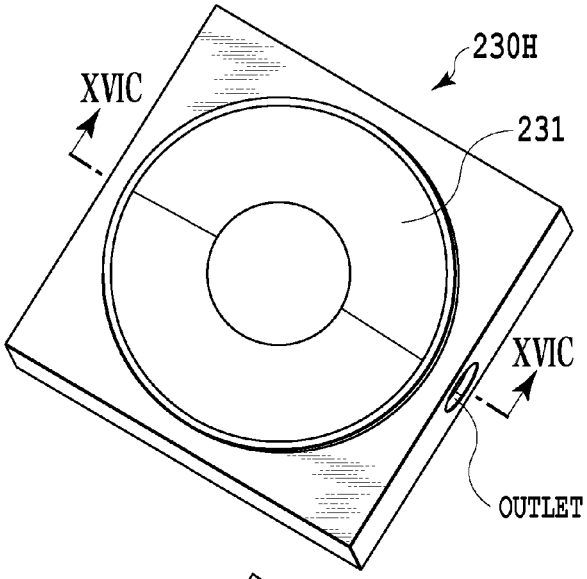
FIG. 16A is a diagram illustrating a pressure adjustment mechanism of a second circulation configuration.
Figure 16B:
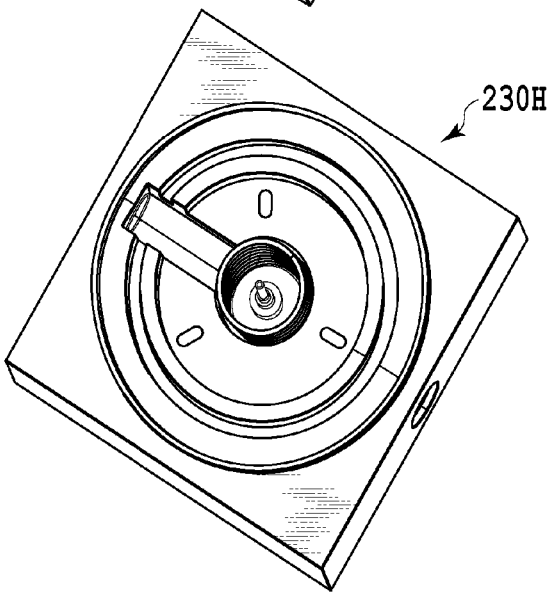
FIG. 16B is a diagram illustrating the pressure adjustment mechanism of the second circulation configuration.
Figure 16C:
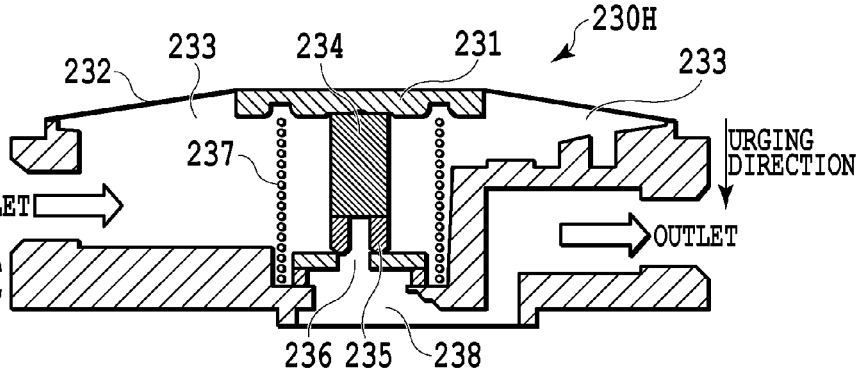
FIG. 16C is a diagram illustrating the pressure adjustment mechanism of the second circulation configuration.

FIG. 16A and FIG. 16B are external perspective views illustrating the pressure control unit 230 (back pressure valve) used in the second circulation configuration. FIG. 16C is a cross-sectional view thereof. The pressure adjustment mechanism 230L on the low pressure side has the same configuration except that a control pressure (initial load of a spring) is different, and thus a description of the pressure adjustment mechanism 230L will be omitted. An operation principle of the pressure adjustment mechanism 230H in FIG. 16A to FIG. 16C is the same as that of a mechanism generally referred to as a "back pressure valve". FIG. 16B illustrates a state in which the pressure plate 231 and the flexible film 232 are not illustrated such that the inside of the pressure adjustment mechanism 230H is easily viewed. FIG. 16C is a diagram illustrating a cross section taken along XVIC-XVIC line of FIG. 16A.

As illustrated in FIG. 16C, a difference from the pressure adjustment mechanism 230H involved with a pressure reducing scheme of FIGS. 14A to 14C is that the valve 235 is disposed inside the first pressure chamber 233, and a direction of the orifice 236 is reversed accordingly. Further, the pressure adjustment mechanism 230H of FIG. 16C is different from that of FIGS. 14A to 14C in that a gap between the orifice 236 and the valve 235 is enlarged when the pressure plate 231 moves upward, and an inlet and an outlet of ink of the pressure adjustment mechanism 230H are reversed.

A scheme described in FIGS. 14A to 14C may be applied to a pressure adjustment mechanism except that P1 is set to a pressure at a downstream side of the orifice 236 in Expression (1) and Expression (2) described above.

(Description of Ink Filling Time)

Figure 17:
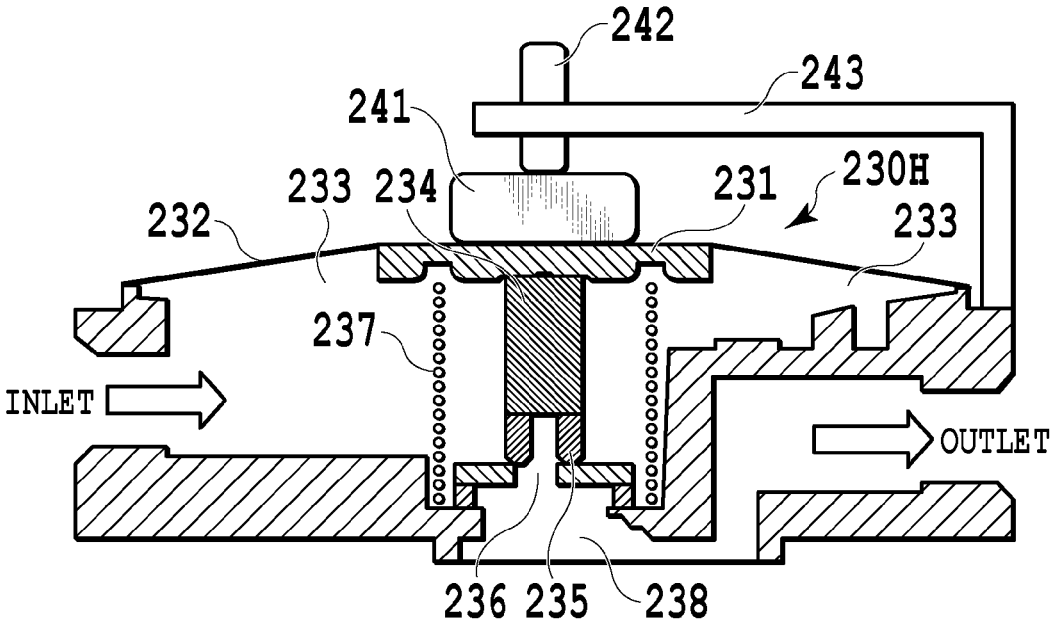
FIG. 17 is a cross-sectional view of the pressure adjustment mechanism at the time of ink filling.

Next, a description will be given of an operation of filling the liquid ejection apparatus 1000 of the present embodiment with ink. FIG. 17 is a cross-sectional view illustrating a configuration of the pressure adjustment mechanism 230H at the time of ink filling in the present embodiment. In the present example, the pressure adjustment mechanism 230H used in the second circulation configuration is described as an example. However, the same configuration may be obtained when the pressure adjustment mechanism 230H used in the first circulation configuration is adopted. The pressure adjustment mechanism 230L on the low pressure side has the same configuration except that a control pressure (initial load of a spring) is different, and thus a description of the pressure adjustment mechanism 230L will be omitted.

In the present embodiment, when the insides of the common supply passage 211, the common collection passage 212, and the individual passage 215 of the liquid ejection head 3 are filled with ink, first, a certain amount of ink is transferred from the main tank 1006 to the buffer tank 1003 by driving the replenishing pump 1005.

Subsequently, as illustrated in FIG. 17, a screw 242 is adjusted to fix a position of a constraining plate 241 such that one end of the constraining plate 241 comes into contact with the pressure plate 231 and the valve 235 is closed. The other end of the constraining plate 241 is connected to a holding member 243 through the screw 242. The holding member 243 is fixed to a main body of the pressure adjustment mechanism 230H, and fixes the constraining plate 241. The constraining plate 241, the screw 242, and the holding member 243 have rigidity that reduces deformation of the pressure plate 231 with respect to a pressure received by the pressure plate 231 resulting from pressurization from the first circulation pumps 1001 and 1002 and the second circulation pump 1004. In the present embodiment, the screw 242 is used to fix the position of the constraining plate 241. However, a manual lever mechanism, a motor, etc. may be used.

Subsequently, the insides of the common supply passage 211, the common collection passage 212, and the individual passage 215 of the liquid ejection head 3 are filled with ink by driving the first circulation pumps 1001 and 1002 and the second circulation pump 1004 to press ink inside the circulation path. When the circulation pumps 1001 to 1004 are driven, the constraining plate 241 causes the pressure plate 231 of the pressure adjustment mechanism 230H to close the valve 235. Thus, the valve 235 is not opened even when a pressure inside the pressure adjustment mechanism rises. For this reason, the passage inside the liquid ejection head 3 may be maintained in a pressurized state and filled with ink. After the passage inside the liquid ejection head 3 is filled with ink, the screw 242 is opened to separate the constraining plate 241 from the pressure plate 231. Then, the valve 235 is opened, and the circulation passage to the buffer tank 1003 and the pressure control unit 230 (the pressure adjustment mechanism 230H and the pressure adjustment mechanism 230L) is filled with ink.

When a forcible blocking mechanism such as the constraining plate 241, the screw 242, the holding member 243, etc. is used for the pressure adjustment mechanism 230H, the inside of the liquid ejection apparatus 1000 may be filled with ink without providing a separate valve in the ink circulation path. According to this configuration, a mechanism for applying a pressure to the inside of the liquid ejection head is not needed when the liquid ejection apparatus 1000 is replenished with ink, and thus it is possible to suppress an increase in cost and to inhibit an apparatus structure from being complicated.

Modified Example 1

Hereinafter, Modified Example 1 of the present embodiment will be described. In the present modified example, a control pressure of the pressure adjustment mechanism 230H is set to a positive pressure in the first circulation configuration. A pressure at the ejection opening 13 in the print standby state is a pressure between a pressure in the common supply passage 211 and a pressure in the common collection passage 212. In the present modified example, a flow rate of ink passing through the ejection opening 13 may be increased by setting a differential pressure between the pressure in the common supply passage 211 and the pressure in the common collection passage 212 to a large value without excessively decreasing the pressure at the ejection opening 13.

When the pressure at the ejection opening 13 may not be taken into consideration, a flow rate of ink passing through the individual passage 215 may be increased by setting a control pressure of the pressure adjustment mechanism 230L to a low pressure while maintaining the control pressure of the pressure adjustment mechanism 230H. However, when the pressure at the ejection opening 13 is lowered, a meniscus position of the ejection opening 13 may be shifted to excessively fall inside the individual passage 215, and formation of droplets discharged from the ejection opening 13 may be affected in some cases. Specifically, more satellites of droplets are formed after discharge, or a minute satellite is generated. There is a concern that image degradation due to satellites of droplets is caused, and the inside of the liquid ejection apparatus 1000 is contaminated due to the minute satellite becoming a mist.

According to the present modified example, the pressure at the ejection opening 13 is not excessively lowered, and thus a generation of a satellite may be prevented. Furthermore, ink thickening or bubble material removal effect is increased. For example, it is possible to employ a configuration, in which a direction of action of a spring force kx corresponding to a product of a spring constant and spring displacement in Expression (1) described above is reversed, to set the control pressure of the pressure adjustment mechanism 230H to the positive pressure. The second term of the right side in this case (Expression (1)) becomes (P1Sv−Kx)/Sd. Thus, under the condition of P1Sv<Kx, an inequality of P2>P0 is satisfied, and P2 becomes a positive pressure.

Figure 18:
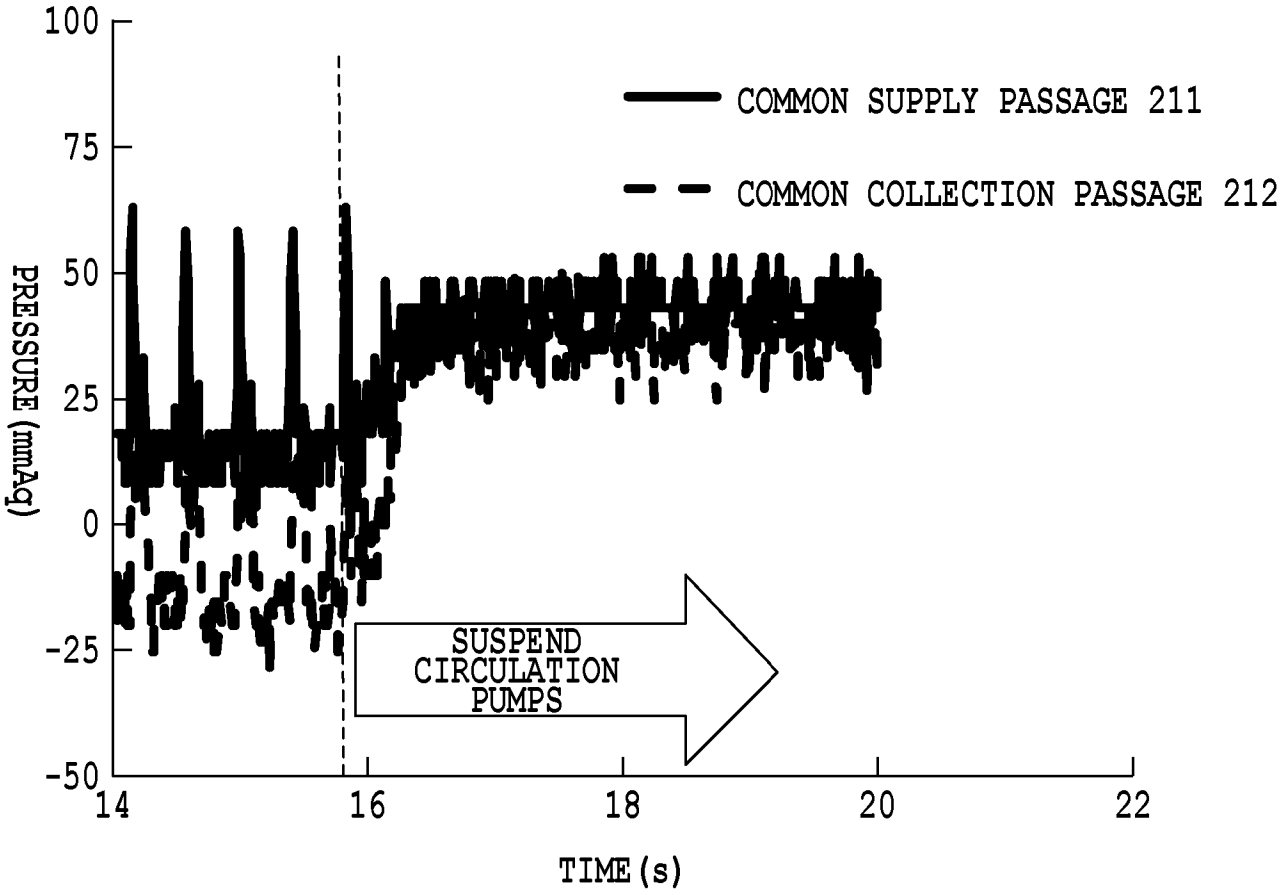
FIG. 18 is a transition diagram illustrating a pressure change in a common passage in Modified Example 1.

FIG. 18 is a transition diagram illustrating pressure changes inside the common supply passage 211 and the common collection passage 212 before and after the first circulation pumps 1001 and 1002 are suspended in the present modified example. As illustrated in FIG. 18, when the first circulation pumps 1001 and 1002 are suspended, a pressure in the common collection passage 212 rises to approach a pressure in the common supply passage 211 since ink flows through the individual supply path 213 and the individual collection path 214 in a direction in which a differential pressure between the pressure in the common supply passage 211 and the pressure in the common collection passage 212 is relieved immediately after the first circulation pumps 1001 and 1002 are suspended.

The pressure adjustment mechanism 230H of the present modified example is a pressure reducing valve-type pressure adjustment mechanism, and thus a higher pressure than the control pressure is applied to the pressure adjustment mechanism 230L. As a result, the valve 235 of the pressure adjustment mechanism 230L is closed. Meanwhile, in the pressure adjustment mechanism 230H, the valve 235 continues to be open when ink flows, and a pressure in the first pressure chamber 233 maintained at the control pressure. When the ink continues to flow, and thus a pressure in the first pressure chamber 233 in the pressure adjustment mechanism 230L rises up to the control pressure of the pressure adjustment mechanism 230H, the flow of ink is suspended, and the valve 235 of the pressure adjustment mechanism 230H is closed. According to this configuration, in the present modified example, as illustrated in FIG. 18, the pressure in the common collection passage 212 rises to approach the pressure in the common supply passage 211, and the differential pressure between the pressure in the common supply passage 211 and the pressure in the common collection passage 212 is relieved.

In the present modified example, when the first circulation pumps 1001 and 1002 are suspended, the pressure in the common supply passage 211 rises. This phenomenon is general in a pressure control scheme using a pressure reducing valve. In other words, it is presumed that the control pressure of the pressure adjustment mechanism 230H slightly rises by being affected by the second circulation pump 1004 corresponding to a pressurization source at the time of suspension since the valve 235 is closed due to minute vibration, etc. in a state in which a balance method of a spring force and a force is disrupted immediately before the valve 235 is fully closed. For this reason, in the present modified example, when the first circulation pumps 1001 and 1002 are suspended, a pressure in a passage inside the liquid ejection head 3 becomes a positive pressure higher than that before suspension. In this state, ink leaks from the ejection opening 13. Thus, in the present modified example, a control system is separately needed to release the rising pressure at the time of suspending printing by providing a separate negative pressure source and valve in an ink supply path other than the ejection opening 13.

Modified Example 2

Hereinafter, Modified Example 2 of the present embodiment will be described. In the present modified example, a control pressure of the pressure adjustment mechanism 230H is set to a positive pressure in the second circulation configuration. An ink flow in a printing state and a print standby state, and a pressure at the ejection opening 13 are similar to those in Modified Example 1. A flow rate of ink passing through the ejection opening 13 may be increased without excessively lowering the pressure at the ejection opening 13. The present modified example is different from Modified Example 1 in pressure changes inside the common supply passage 211 and the common collection passage 212 when the circulation pumps are suspended after printing ends.

Figure 19:
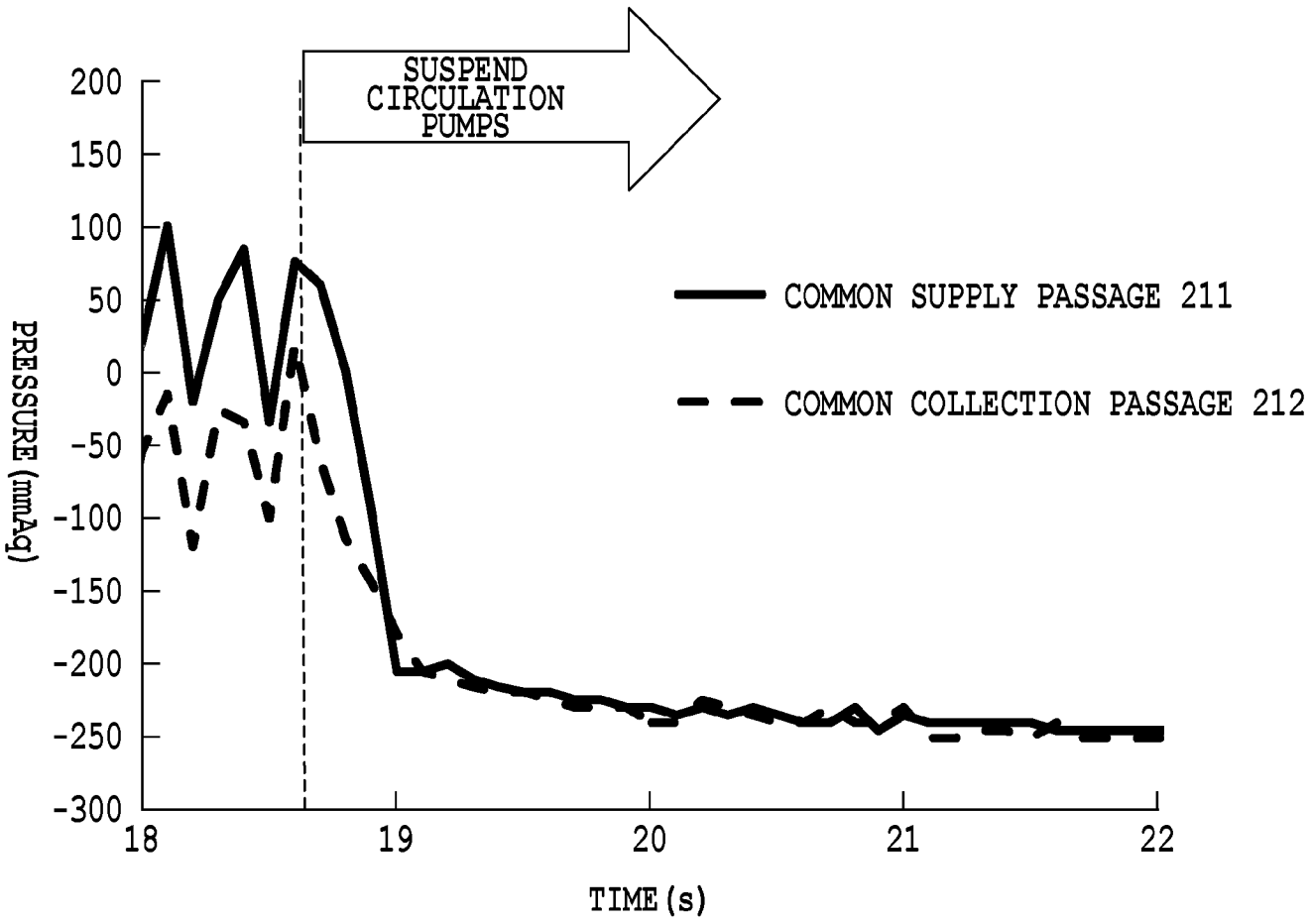
FIG. 19 is a transition diagram illustrating a pressure change in a common passage in Modified Example 2.

FIG. 19 is a transition diagram illustrating pressure changes inside the common supply passage 211 and the common collection passage 212 before and after the first circulation pumps 1001 and 1002 are suspended in Modified Example 2. As illustrated in FIG. 19, pressure values fluctuate due to pulses by the first circulation pumps 1001 and 1002 before the circulation pumps are suspended. When the first circulation pumps 1001 and 1002 are suspended, a pressure in the common supply passage 211 decreases to approach a pressure in the common collection passage 212 since ink flows through the individual supply path 213 and the individual collection path 214 in a direction in which a differential pressure between the pressure in the common supply passage 211 and the pressure in the common collection passage 212 is relieved immediately after the first circulation pumps 1001 and 1002 are suspended.

The pressure adjustment mechanism 230H of the present modified example is a back pressure valve-type pressure adjustment mechanism, and thus a higher pressure than the control pressure is applied to the pressure adjustment mechanism 230L. As a result, the valve 235 of the pressure adjustment mechanism 230L is opened, and a pressure in the first pressure chamber 233 is maintained at the control pressure. Meanwhile, in the pressure adjustment mechanism 230H, the pressure in the first pressure chamber 233 decreases when ink flows, and thus the valve 235 is closed. When the ink continues to flow, and thus the pressure in the first pressure chamber 233 in the pressure adjustment mechanism 230H decreases up to the control pressure of the pressure adjustment mechanism 230L, the flow of ink is suspended, and the valve 235 of the pressure adjustment mechanism 230L is closed. According to this configuration, in the present modified example, as illustrated in FIG. 19, the pressure in the common collection passage 212 rises to approach the pressure in the common supply passage 211, and the differential pressure between the pressure in the common supply passage 211 and the pressure in the common collection passage 212 is relieved.

In the present modified example, when the first circulation pumps 1001 and 1002 are suspended, the pressure in the common collection passage 212 decreases. This phenomenon is general in a pressure control scheme using a back pressure valve. In other words, it is presumed that the control pressure of the pressure adjustment mechanism 230L slightly decreases by being affected by the second circulation pump 1004 corresponding to a negative pressure source at the time of suspension since the valve 235 is closed due to minute vibration, etc. in a state in which a balance method of a spring force and a force is disrupted immediately before the valve 235 is fully closed. For this reason, in the present modified example, when the first circulation pumps 1001 and 1002 are suspended, a pressure in a passage inside the liquid ejection head 3 becomes a negative pressure lower than that before suspension. Therefore, in the printing state and the print standby state, ink may be prevented from leaking from the ejection opening 13 of the liquid ejection head 3 even when a pressure inside the common supply passage 211 becomes a positive pressure.

Figure 20:
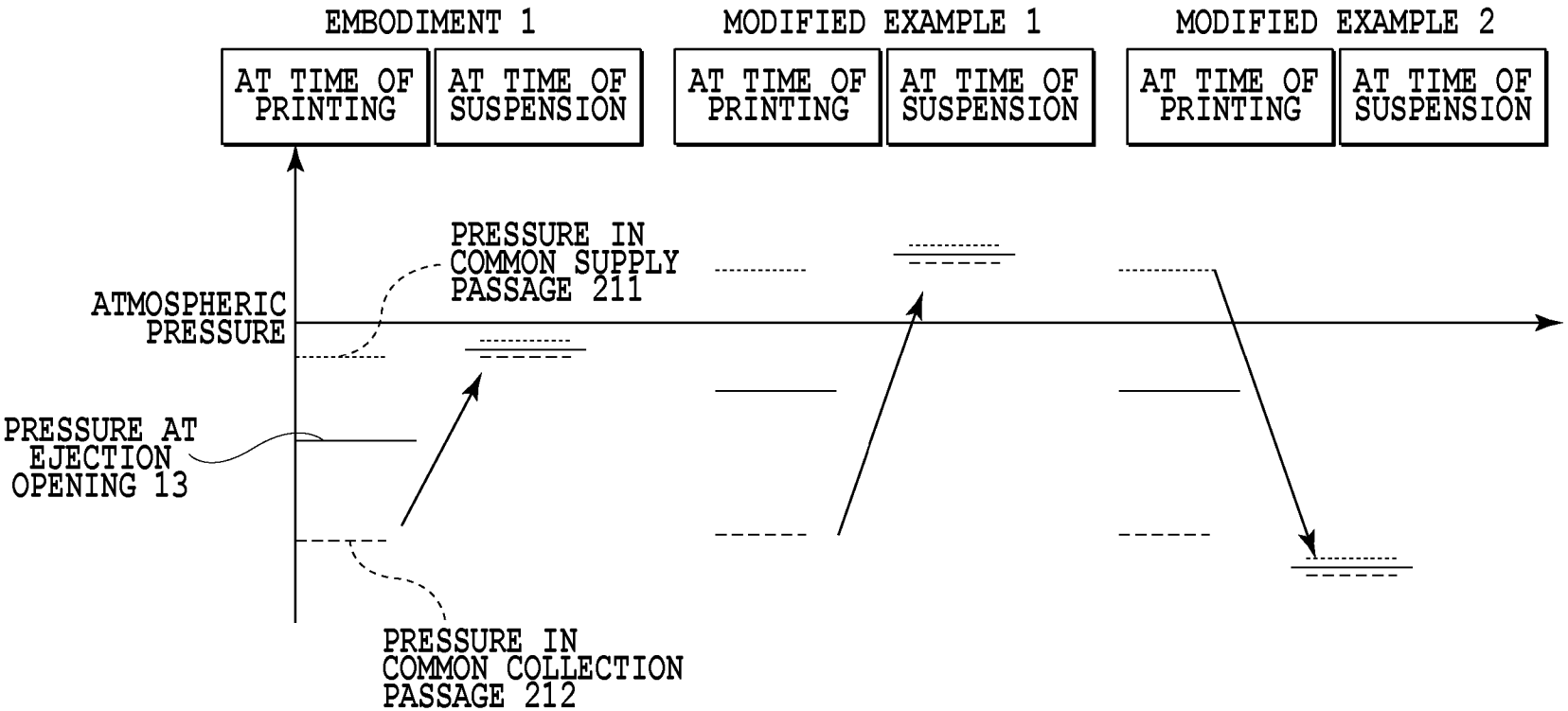
FIG. 20 is a schematic diagram in which pressure variations at a liquid ejection head are compared.

FIG. 20 is a schematic diagram in which pressure variations at the liquid ejection head 3 are compared after suspending an operation of the liquid ejection apparatus 1000 in Embodiment 1, Modified Example 1, and Modified Example 2. As illustrated in FIG. 20, in Modified Example 1, the pressure in the common collection passage 212 rises to approach the pressure in the common supply passage 211, and thus the differential pressure between the pressure in the common supply passage 211 and the pressure in the common collection passage 212 is relieved. Meanwhile, in Modified Example 2, the pressure in the common supply passage 211 decreases to approach the pressure in the common collection passage 212, and thus the differential pressure between the pressure in the common supply passage 211 and the pressure in the common collection passage 212 is relieved. In particular, Modified Example 2 is advantageous in that a passing flow rate of ink may be increased without decreasing the pressure at the ejection opening 13, and the pressure inside the liquid ejection head 3 may be autonomously suspended at a negative pressure at the time of suspending the operation of the liquid ejection apparatus 1000.

Embodiment 2

Hereinafter, configurations of an liquid ejection apparatus 2000 and a liquid ejection head 2003 according to an embodiment 2 will be described with reference to the drawings. In the description below, only a difference from the embodiment 1 will be described and a description of the same components as those of the embodiment 1 will be omitted.

(Description of Liquid Ejection Apparatus)

Figure 21:
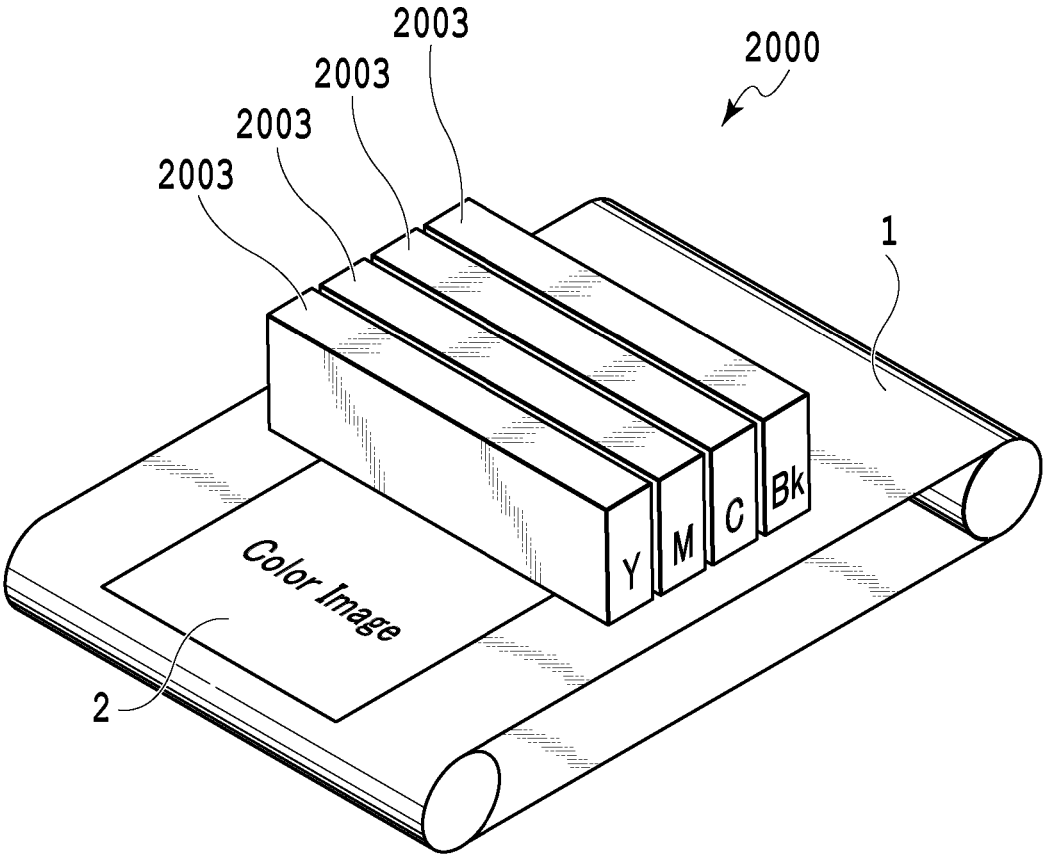
FIG. 21 is a schematic configuration diagram of a liquid ejection apparatus in Embodiment 2.

FIG. 21 is a diagram illustrating the liquid ejection apparatus 2000 according to the present embodiment. The liquid ejection apparatus 2000 of the present embodiment is different from the embodiment 1 in that a full color image is printed on the print medium by a configuration in which four monochromic liquid ejection heads 2003 respectively corresponding to the inks of cyan C, magenta M, yellow Y, and black K are disposed in parallel. In the embodiment 1, the number of the ejection opening rows which can be used for one color is one. However, in the present embodiment, the number of the ejection opening rows which can be used for one color is twenty. For this reason, when print data is appropriately distributed to a plurality of ejection opening rows to print an image, an image can be printed at a higher speed. Further, even when there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to embodiment 1, the supply system, the buffer tank 1003 (see FIGS. 2 and 3), and the main tank 1006 (see FIGS. 2 and 3) of the liquid ejection apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the embodiment 1, the first and second circulation configurations illustrated in FIG. 2 or 3 can be used as the liquid circulation configuration between the liquid ejection apparatus 2000 and the liquid ejection head 2003.

(Description of Structure of Liquid Ejection Head)

Figure 22A:
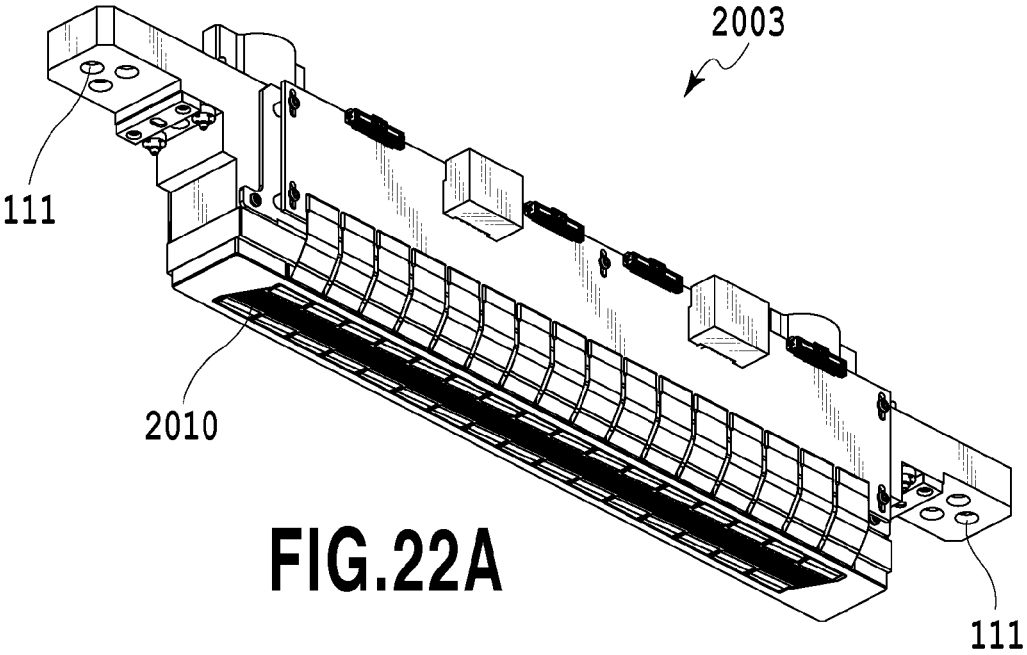
FIG. 22A is a perspective view illustrating a liquid ejection head in Embodiment 2.
Figure 22B:
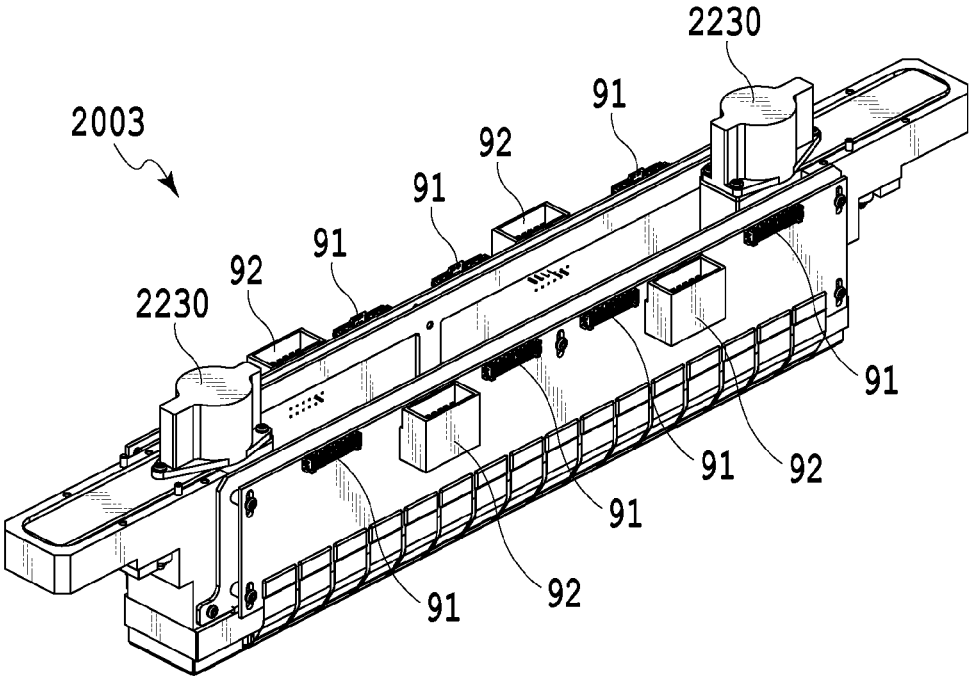
FIG. 22B is a perspective view illustrating the liquid ejection head in Embodiment 2.

FIGS. 22A and 22B are perspective views illustrating the liquid ejection head 2003 according to the present embodiment. Here, a structure of the liquid ejection head 2003 according to the present embodiment will be described. The liquid ejection head 2003 is an inkjet line type print head which includes sixteen print element boards 2010 arranged linearly in the longitudinal direction of the liquid ejection head 2003 and can print an image by one kind of liquid. Similarly to the embodiment 1, the liquid ejection head 2003 includes the liquid connection portion 111, the signal input terminal 91, and the power supply terminal 92. However, since the liquid ejection head 2003 of the present embodiment includes many ejection opening rows compared with the embodiment 1, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 23:
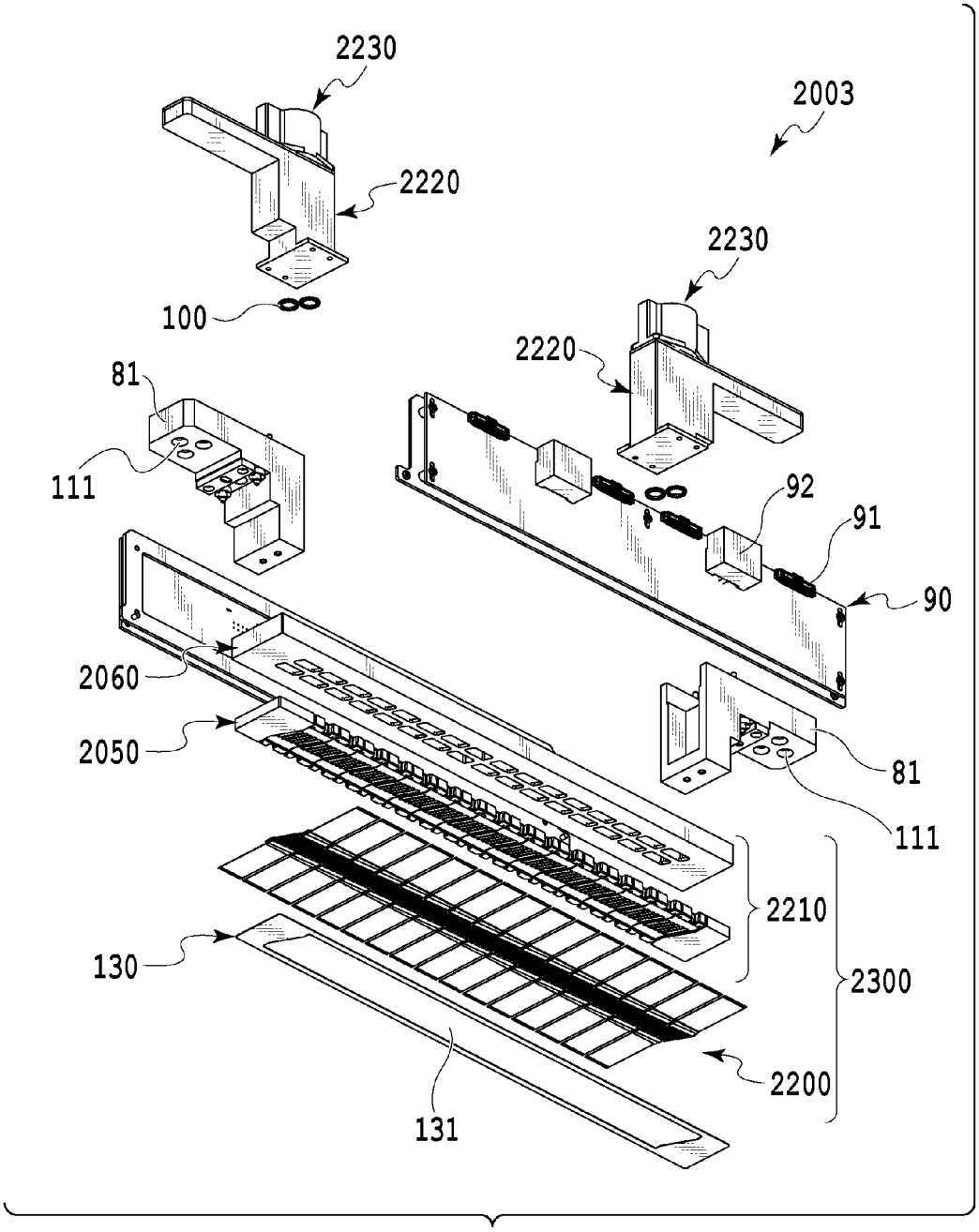
FIG. 23 is an oblique exploded view of the liquid ejection head in Embodiment 2.

FIG. 23 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the embodiment 1, but the function of guaranteeing the rigidity of the liquid ejection head is different. In the embodiment 1, the rigidity of the liquid ejection head is mainly guaranteed by the liquid ejection unit support portion 81, but in the liquid ejection head 2003 of the embodiment 2, the rigidity of the liquid ejection head is guaranteed by a second passage member 2060 included in a liquid ejection unit 2300. The liquid ejection unit support portion 81 of the present embodiment is connected to both ends of the second passage member 2060 and the liquid ejection unit 2300 is mechanically connected to a carriage of the liquid ejection apparatus 2000 to position the liquid ejection head 2003. The electric wiring board and a liquid supply unit 2220 including a pressure control unit 2230 are connected to the liquid ejection unit support portion 81. Each of two liquid supply units 2220 includes a filter (not illustrated) built therein.

Two pressure control units 2230 are set to control a pressure at different and relatively high and low negative pressures. Further, as in FIGS. 22A and 22B, when the pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 23, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 24:
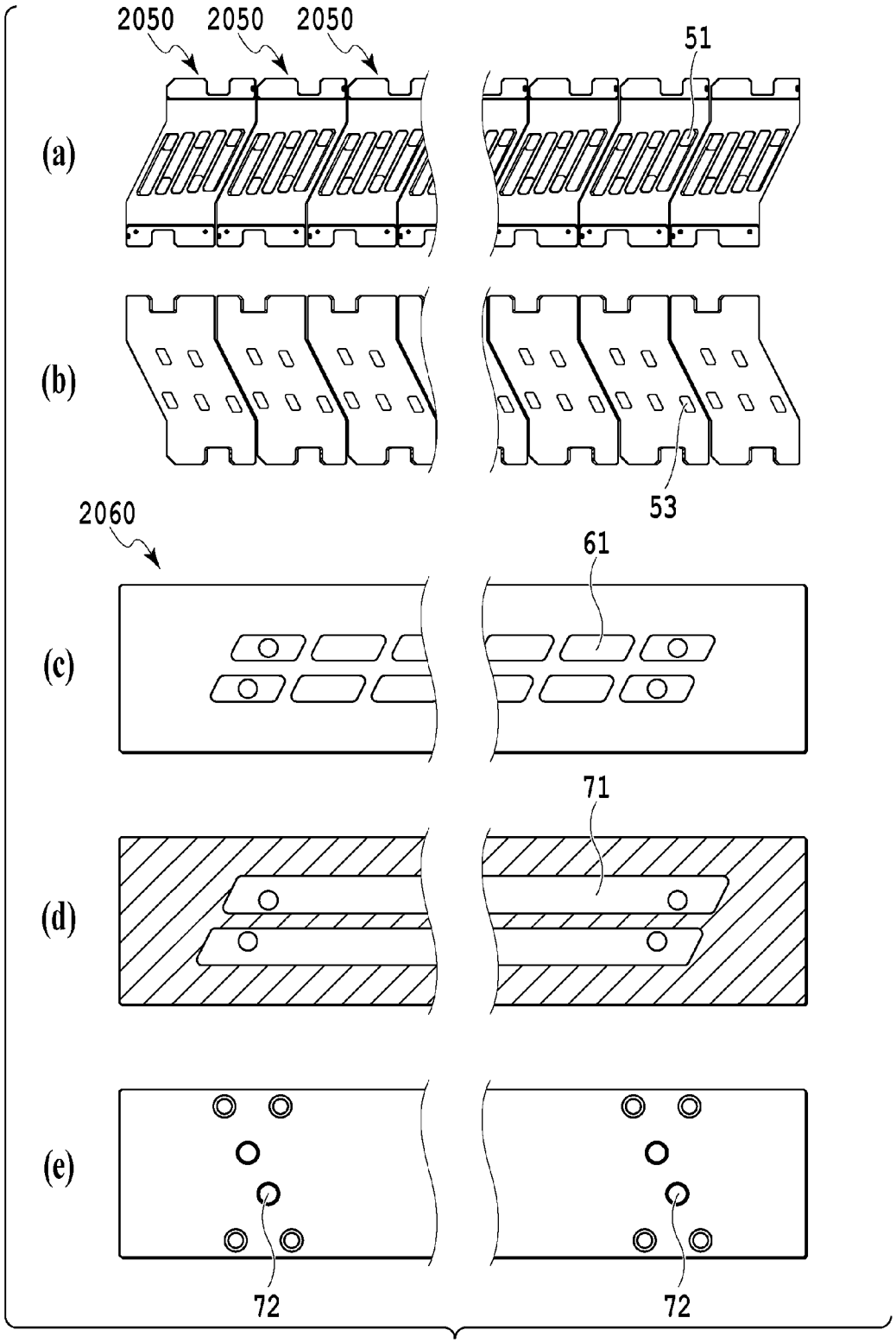
FIG. 24 is a diagram illustrating the first passage member in Embodiment 2.

A reference character (a) in FIG. 24 is a diagram illustrating a face onto which the ejection module 2200 is mounted in the first passage member 2050 and a reference character (b) is a diagram illustrating a rear face thereof and a face contacting the second passage member 2060. Differently from the embodiment 1, the first passage member 2050 of the present embodiment has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in the character (a), the communication opening 51 of the first passage member 2050 fluid-communicates with the ejection module 2200. As illustrated in the reference character (b), the individual communication opening 53 of the first passage member 2050 fluid-communicates with the communication opening 61 of the second passage member 2060. A reference character (c) illustrates a contact face of the second passage member 60 with respect to the first passage member 2050, a reference character (d) illustrates a cross-section of a center portion of the second passage member 60 in the thickness direction, and a reference character (e) is a diagram illustrating a contact face of the second passage member 2060 with respect to the liquid supply unit 2220. The function of the communication opening or the passage of the second passage member 2060 is similar to each color of the embodiment 1. The common passage groove 71 of the second passage member 2060 is formed such that one side thereof is a common supply passage 2211 illustrated in FIG. 25 and the other side thereof is a common collection passage 2212. These passages are respectively provided along the longitudinal direction of the liquid ejection head 2003 so that the liquid is supplied from one end thereof to the other end thereof. The present embodiment is different from the embodiment 1 in that the liquid flow directions in the common supply passage 2211 and the common collection passage 2212 are opposite to each other.

Figure 25:
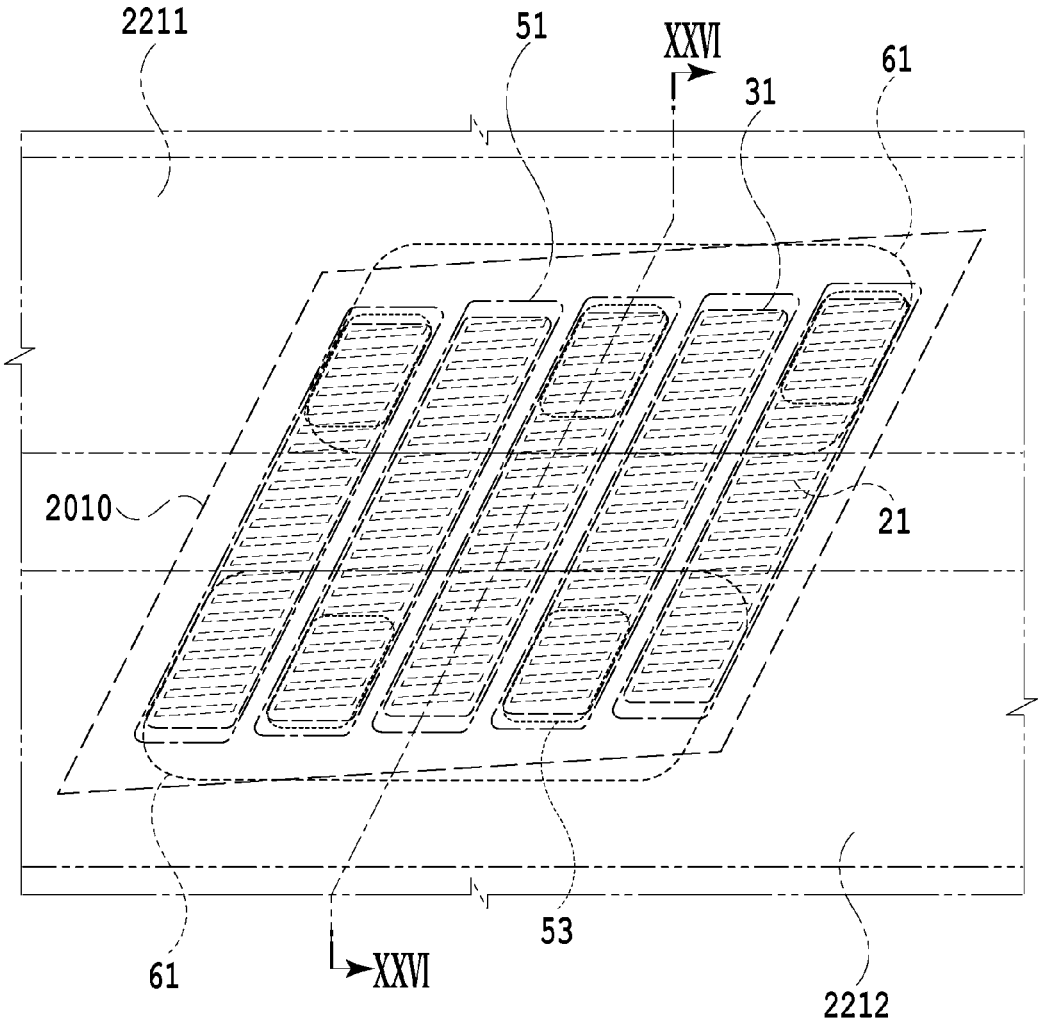
FIG. 25 is an enlarged perspective view around a print element board in Embodiment 2.

FIG. 25 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 26:
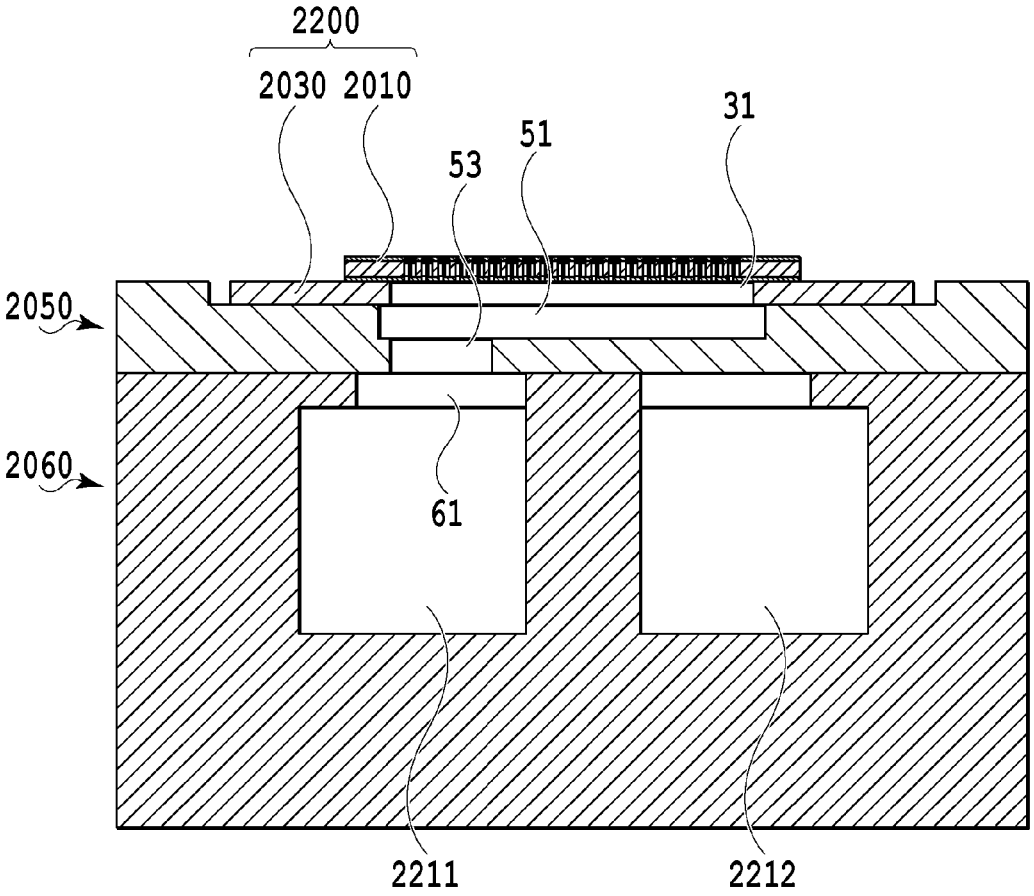
FIG. 26 is a diagram illustrating a cross section taken along XXVI-XXVI line of FIG. 25.

FIG. 26 is a cross-sectional view taken along a line XXVI-XXVI of FIG. 25. The common supply passage 2211 is connected to the ejection module 2200 through the communication opening 61, the individual communication opening 53, and the communication opening 51. Although not illustrated in FIG. 26, it is obvious that the common collection passage 2212 is connected to the ejection module 2200 by the same path in a different cross-section in FIG. 25. Similarly to the embodiment 1, each of the ejection module 2200 and the print element board 2010 is provided with a passage communicating with each ejection opening and thus a part or the entirety of the supplied liquid can be recirculated while passing through the ejection opening that does not perform the ejection operation. Further, similarly to the embodiment 1, the common supply passage 2211 is connected to the pressure control unit 2230 (the high pressure side) and the common collection passage 2212 is connected to the pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 27A:
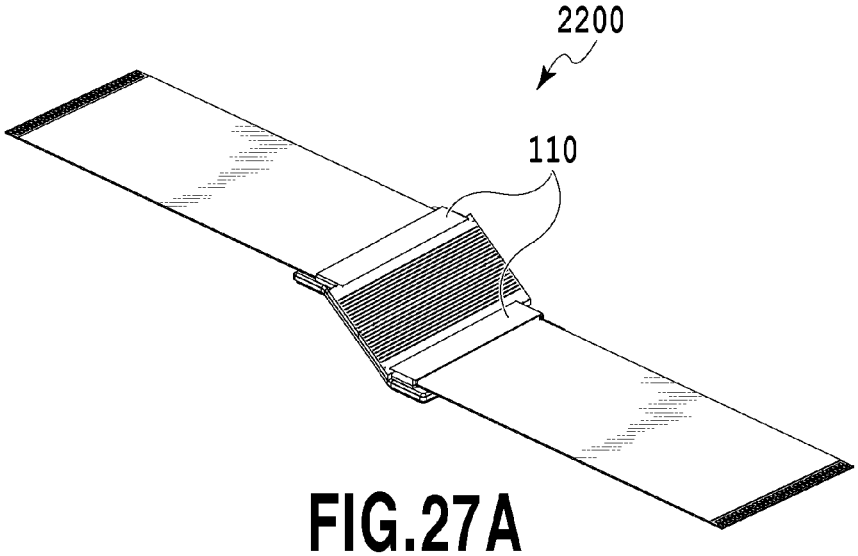
FIG. 27A is a diagram illustrating an ejection module in Embodiment 2.
Figure 27B:
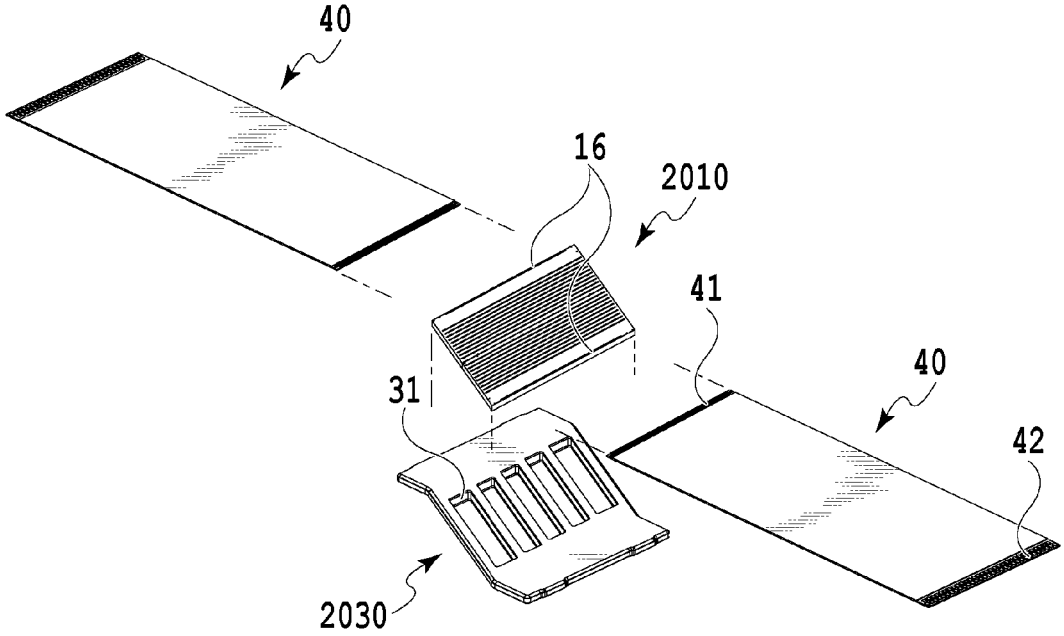
FIG. 27B is a diagram illustrating the ejection module in Embodiment 2.

FIG. 27A is a perspective view illustrating one ejection module 2200 and FIG. 27B is an exploded view thereof. A difference from the embodiment 1 is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the embodiment 1. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the embodiment 1.

(Description of Structure of Print Element Board)

Figure 28:
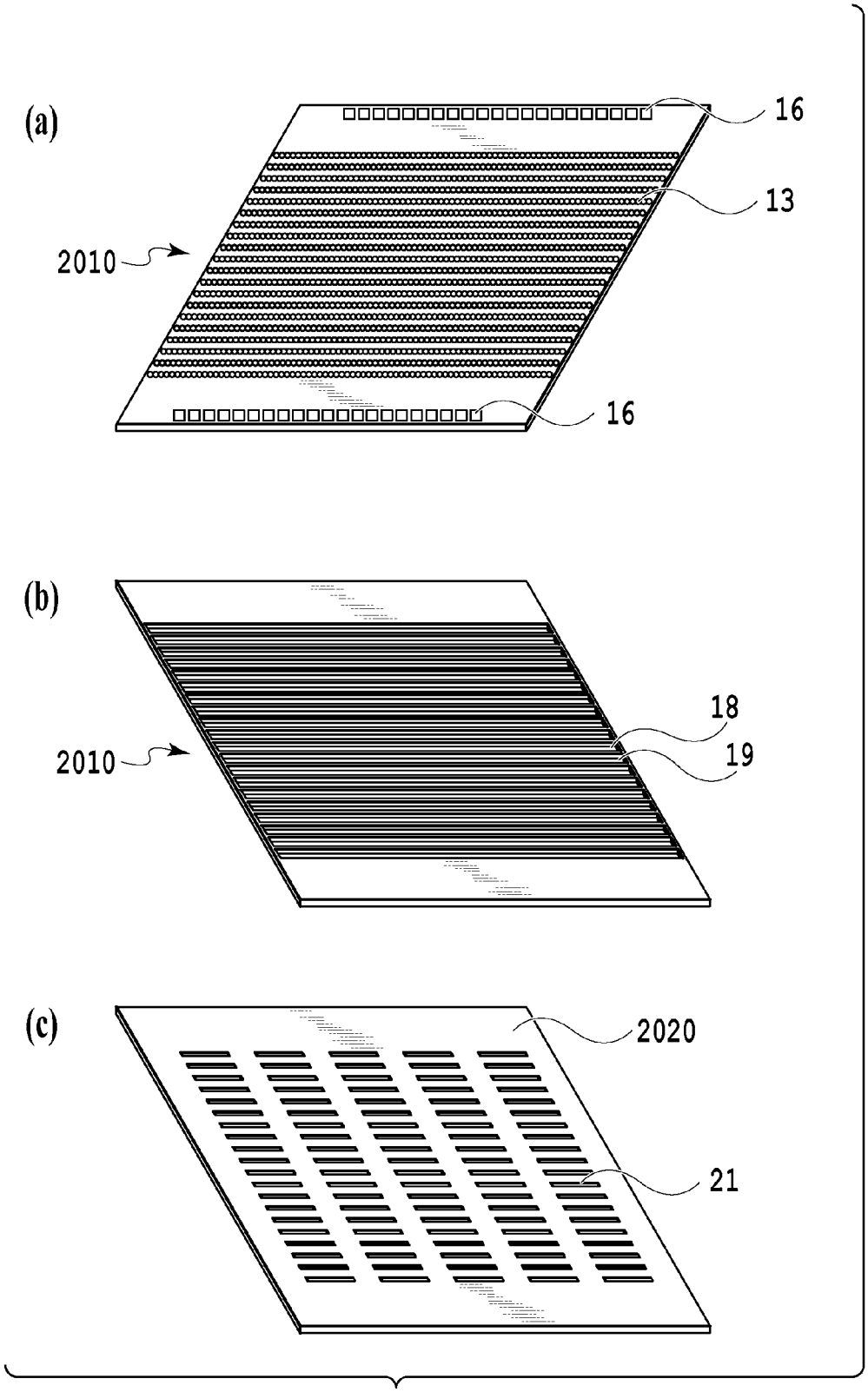
FIG. 28 is a diagram illustrating the print element board in Embodiment 2.

A reference character (a) in FIG. 28 is a schematic diagram illustrating a face on which the ejection opening 13 is disposed in the print element board 2010 and a reference character (c) is a schematic diagram illustrating a rear face of the face of the reference character (a). A reference character (b) is a schematic diagram illustrating a face of the print element board 2010 when a lid member 2020 provided in the rear face of the print element board 2010 in the reference character (c) is removed. As illustrated in the reference character (b), the liquid supply path 18 and the liquid collection path 19 are alternately provided along the ejection opening row direction at the rear face of the print element board 2010. The number of the ejection opening rows is larger than that of the embodiment 1. However, a basic difference from the embodiment 1 is that the terminal 16 is disposed at both sides of the print element board in the ejection opening row direction as described above. A basic configuration is similar to the embodiment 1 in that a pair of the liquid supply path 18 and the liquid collection path 19 is provided in each ejection opening row and the lid member 2020 is provided with the opening 21 communicating with the liquid communication opening 31 of the support member 2030.

In addition, the description of the above-described embodiment does not limit the scope of the invention. As an example, in the present embodiment, a thermal type has been described in which bubbles are generated by a heating element to eject the liquid. However, the invention can be also applied to the liquid ejection head which employs a piezo type and the other various liquid ejection types.

In the present embodiment, the liquid ejection apparatus (the printing apparatus) has been described in which the liquid such as ink is circulated between the tank and the liquid ejection head, but the other embodiments may be also used. In the other embodiments, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the present embodiment, an example of using a so-called line type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the invention is not limited thereto. That is, a liquid ejection head which is shorter than the width of the print medium and includes a plurality of print element boards disposed so that the ejection openings overlap each other in the ejection opening row direction may be provided and the print medium may be scanned by the liquid ejection head.

Modified Example 3

Figure 29:
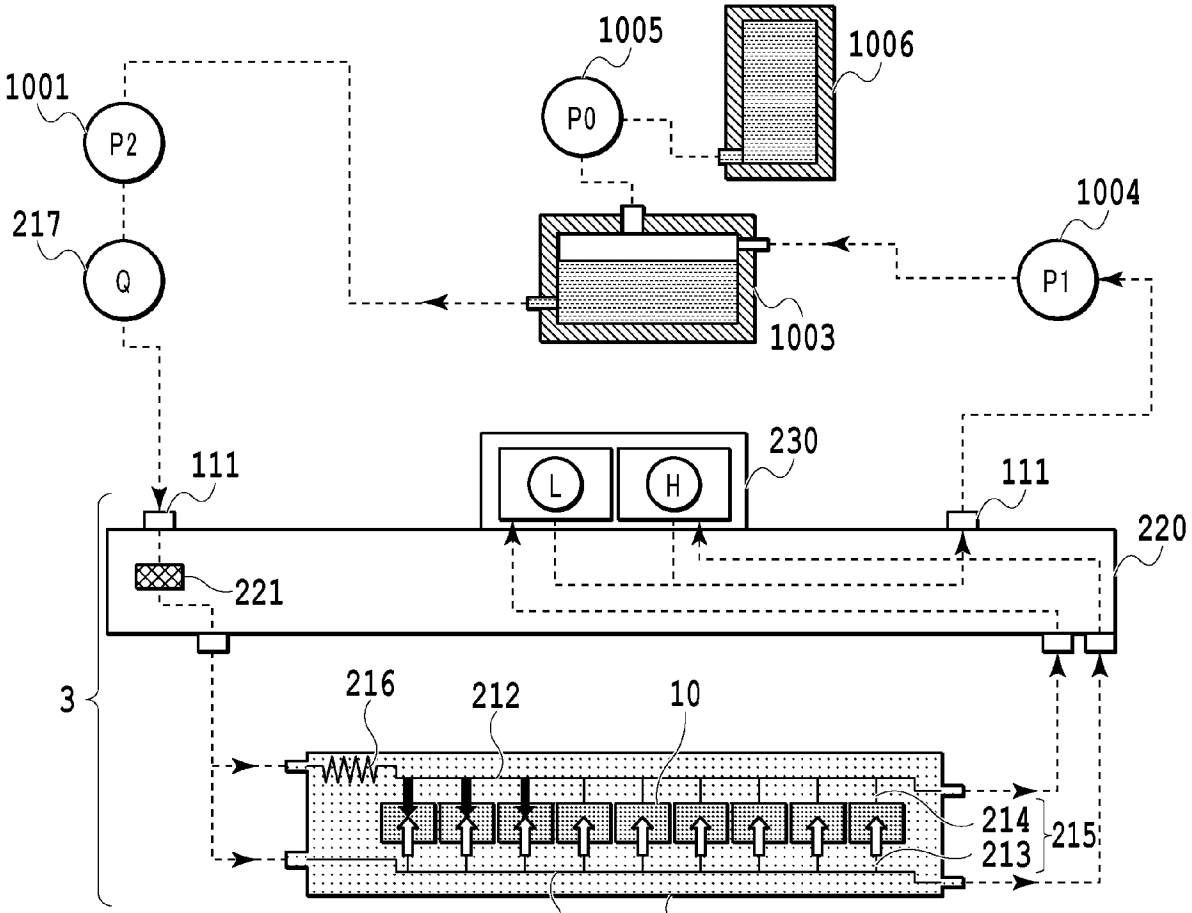
FIG. 29 is a schematic view illustrating a circulation configuration in Modified Example 3.

A description will be given of Modified Example 3 of the present embodiment with reference to FIG. 29. In the present modified example, in the second circulation configuration, both upstream ends of the common supply passage 211 and the common collection passage 212 are connected to the one first circulation pump 1001. In this way, the number of first circulation pumps may be reduced, and thus the configuration is simplified to reduce cost. Further, since the number of connecting portions between respective units is reduced, a leakage risk decreases, and durability and reliability of the liquid ejection apparatus are improved. A flow resistance adjustment unit 216 disposed around the upstream end of the common collection passage 212 has a function of mainly determining distribution of a flow amount between the common supply passage 211 and the common collection passage 212. When the common supply passage 211 and the common collection passage 212 have the same resistance, a higher flow amount of print liquid supplied from the circulation pump 1001 is distributed to the common collection passage 212 since a pressure is lower in the common collection passage 212 than in the common supply passage 211. In the present modified example, the amount of distribution may be adjusted to a desired value when a flow resistance is adjusted by the flow resistance adjustment unit 216. The distribution of the flow amount is determined based on a total ratio of respective flow resistances from a branching portion of the common supply passage 211 and the common collection passage 212 to a negative pressure control unit. Thus, when the flow resistance adjustment unit 216 is not provided as in FIG. 29, for example, when a configuration in which a flow resistance of the whole common collection passage 212 is increased is adopted, the above description may be similarly applied.

In addition, the first circulation pump 1001 and a flow amount sensor 217 disposed at a downstream thereof are electrically connected to a control circuit (not illustrated) of a main body of the liquid ejection apparatus, and the control circuit controls revolutions per minutes (rpm) of the first circulation pump based on an output value from the flow amount sensor 217. Therefore, even when viscosity of ink changes or durability of the pump deteriorates due to a change in environmental temperature, a variation in flow amount is suppressed, and reliability of the liquid ejection apparatus is improved.

Figure 30:
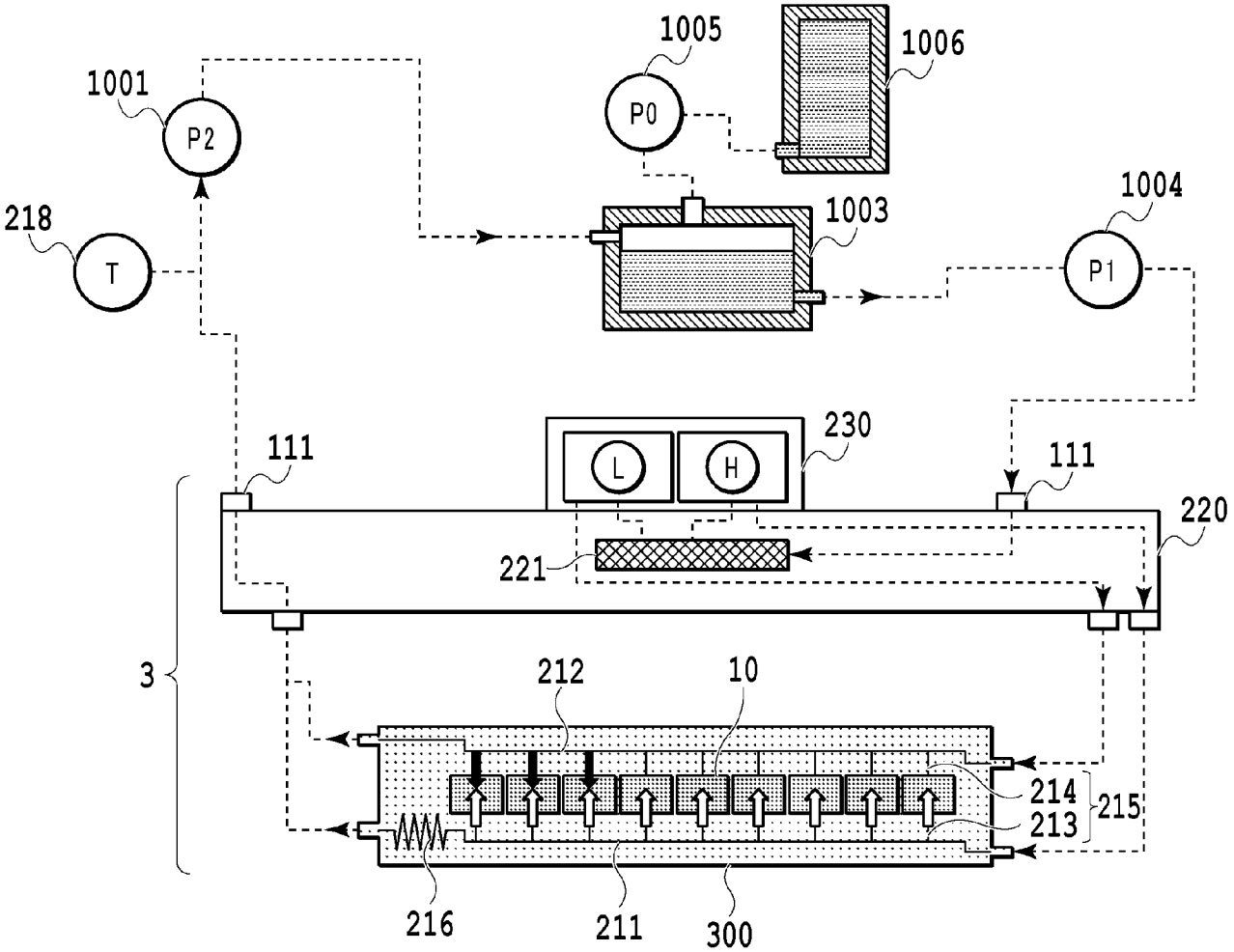
FIG. 30 is a schematic view illustrating a circulation configuration in Modified Example 4.

FIG. 30 schematically illustrates a circulation configuration of Modified Example 4 of the present embodiment. In the present modified example, in the first circulation configuration, both upstream ends of the common supply passage 211 and the common collection passage 212 are connected to the one first circulation pump 1001. In this way, preferable effects such as cost reduction and improvement of durability and reliability are obtained similarly to Modified Example 3.

In addition, the first circulation pump 1001 and a temperature sensor 218 disposed by branching from an upstream thereof are electrically connected to a control circuit (not illustrated) of the main body of the liquid ejection apparatus. In this way, the control circuit estimates a change in viscosity of print liquid using a predetermined coefficient based on an output value from the temperature sensor 218, and controls rpm of the first circulation pump 1001. Even though accuracy of a controlled flow amount is lower than that in a configuration in which a flow amount is directly measured as in Modified Example 3, Modified Example 4 has a circulation configuration that costs less than that of Modified Example 3 since the temperature sensor 218 generally has a simple configuration and costs less than the flow amount sensor.

Modified Example 5

Figure 31:
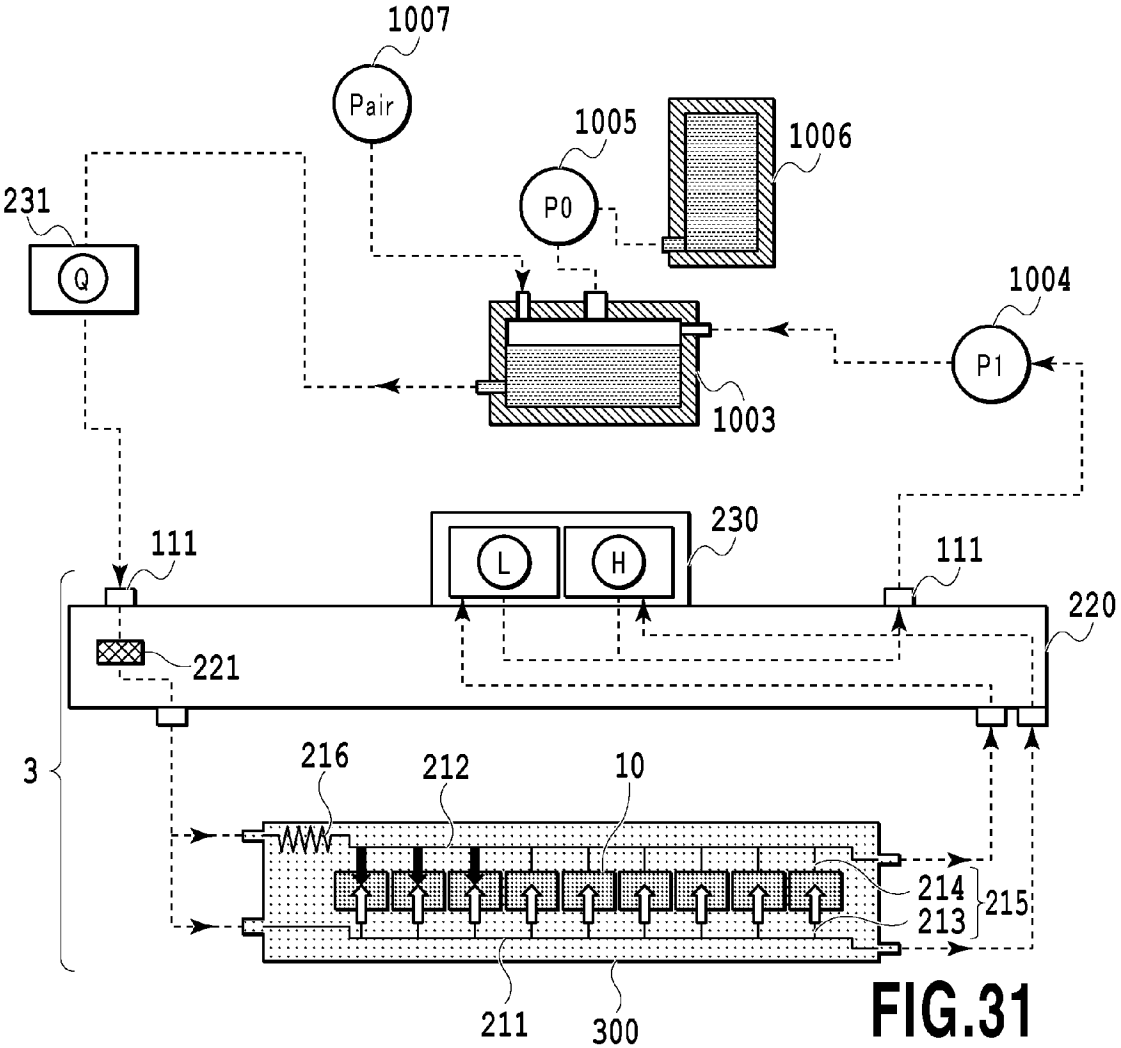
FIG. 31 is a schematic view illustrating a circulation configuration in Modified Example 5.

FIG. 31 is a schematic diagram illustrating a circulation configuration of Modified Example 5 of the present embodiment. In the present modified example, a constant flow valve mechanism 231 is disposed instead of the first circulation pump 1001 and the flow amount sensor 217 of Modified Example 3 of FIG. 29, and an ejection side of an air pump 1007 is connected to the buffer tank 1003. At the time of driving the head, pressurization inside the buffer tank 1003 is maintained by the air pump 1007, and print liquid is returned to the buffer tank 1003 from a liquid ejection unit 3 by the second circulation pump 1004. Meanwhile, the constant flow valve mechanism 231 disposed at an upstream of the liquid ejection unit 3 supplies a certain flow amount of print liquid to the liquid ejection unit 3 using the pressurization inside the buffer tank 1003 as power. The constant flow valve mechanism 231 has a function of varying an internal resistance such that a preset flow amount flows by a valve/spring mechanism inside the mechanism even when a pressure at an upstream and a downstream thereof varies. Even though a flow amount may not be constant at all times with respect to a change in viscosity of print liquid, cost is low since a configuration is simple. In addition, the air pump 1007 may be commonly connected to a buffer tank in an allochromatic circulation path, and thus one air pump may be used for one liquid ejection apparatus, and the air pump may be used for suction recovery of a nozzle. For this reason, it is possible to provide a liquid ejection apparatus that costs less when compared to a circulation configuration using auxiliary machines such as the first circulation pump and the sensor. The same circulation function may be obtained when the first circulation pump is disposed between the constant flow valve mechanism 231 and the buffer tank 1003 without using the air pump 1007. However, the present mode is preferable when a merit in terms of cost is taken into account.

Modified Example 6

Figure 32:
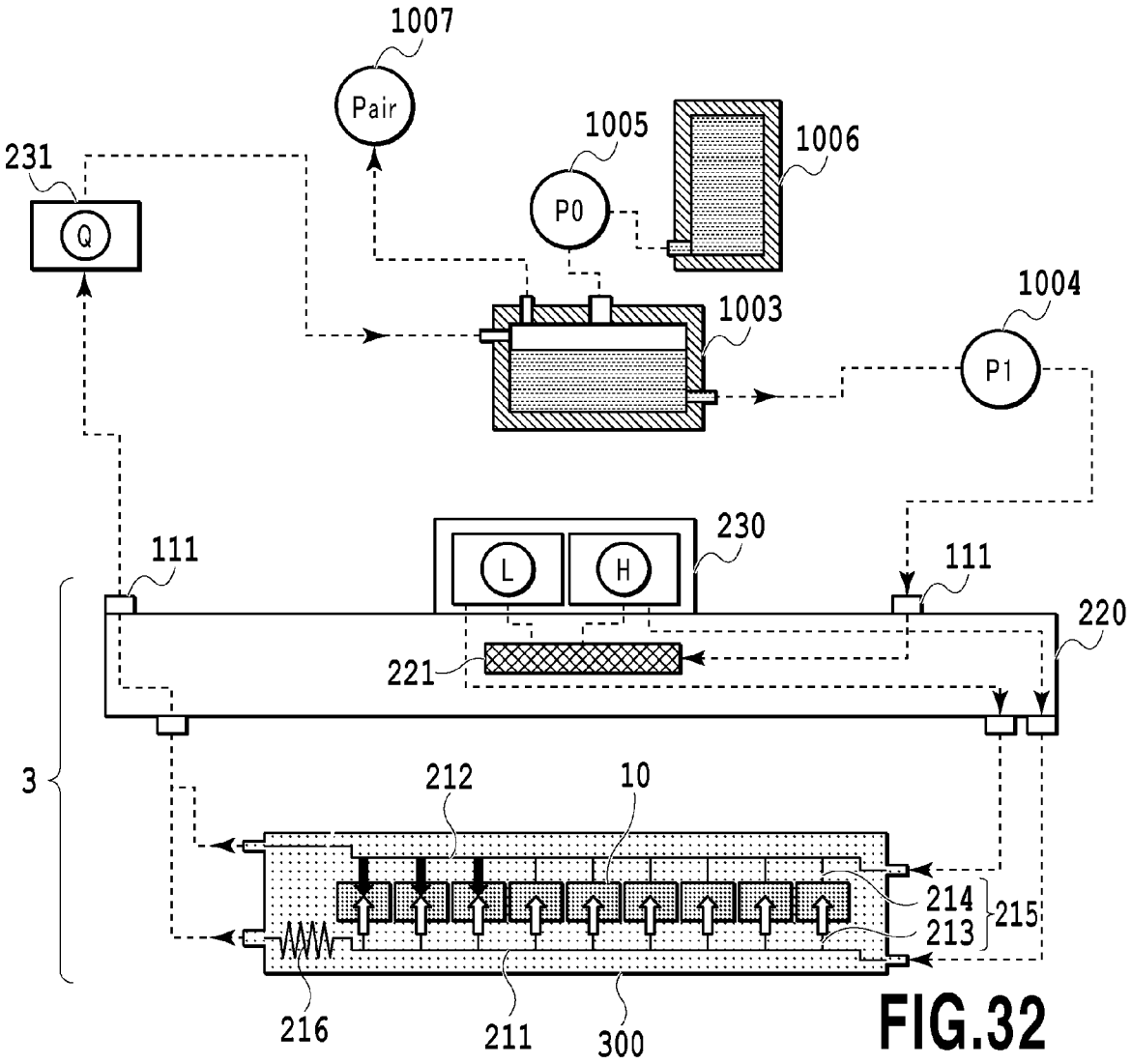
FIG. 32 is a schematic view illustrating a circulation configuration in Modified Example 6.

FIG. 32 is a schematic diagram illustrating a circulation configuration of Modified Example 6 of the present embodiment. In the present modified example, the constant flow valve mechanism 231 is disposed instead of the first circulation pump 1001 and the temperature sensor 218 of Modified Example 4 of FIG. 30, and a suction side of the air pump 1007 is connected to the buffer tank 1003. At the time of driving the head, a high negative pressure inside the buffer tank 1003 is maintained by the air pump 1007, and print liquid is supplied to the liquid ejection unit 3 from the buffer tank 1003 by the second circulation pump 1004. Meanwhile, the constant flow valve mechanism 231 disposed at a downstream of the liquid ejection unit 3 collects a certain flow amount of print liquid from the liquid ejection unit 3 using the high negative pressure inside the buffer tank 1003 as power. The constant flow valve mechanism 231 has a function of varying an internal resistance such that a preset flow amount flows by a valve/spring mechanism inside the mechanism even when a pressure at an upstream and a downstream thereof varies. Even though a flow amount may not be constant at all times with respect to a change in viscosity of print liquid, cost is low since a configuration is simple. In addition, the air pump 1007 may be commonly connected to a buffer tank in an allochromatic circulation path, and thus one air pump may be used for one liquid ejection apparatus, and the air pump may be used for suction recovery of a nozzle.

In the present modified example, another preferable effect is obtained in addition to an advantage of cost reduction. In more detail, at the time of driving the head, a flow field resulting from circulation in a negative pressure state is present inside the buffer tank 1003 at all times, and thus print liquid is spontaneously deaerated simultaneously with start of circulation. For this reason, bubbles remaining inside the liquid ejection head are gradually eliminated when a circulation driving is performed, and thus non-ejection, etc. due to bubbles rarely occurs in long-term use. As a result, in the circulation configuration of the present modified example, it is possible to obtain effects that reliability of head driving is improved, and the amount of spent ink may be reduced by reducing a frequency of recovery of nozzle clogging simultaneously with the merit of cost reduction.

(Description of Constant Flow Valve Mechanism)

Figure 33A:
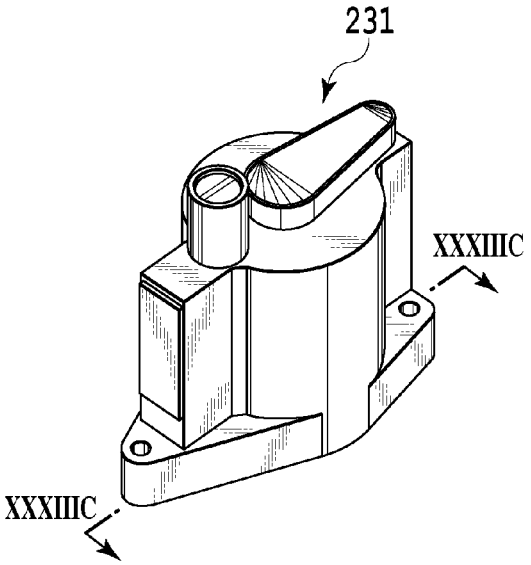
FIG. 33A is a diagram illustrating a configuration of a constant flow valve in Modified Examples 5 and 6.
Figure 33B:
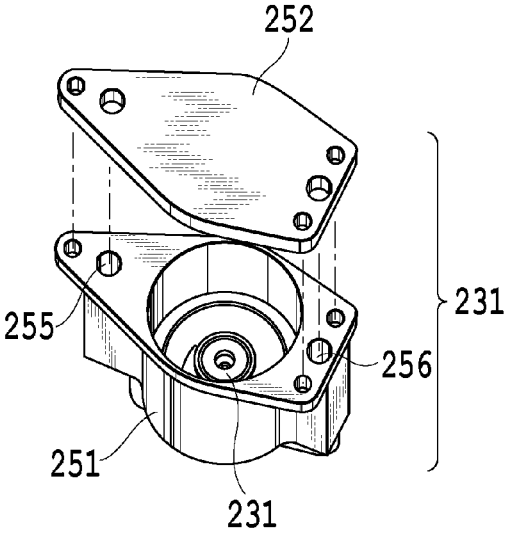
FIG. 33B is a diagram illustrating a configuration of a constant flow valve in Modified Examples 5 and 6.
Figure 33C:
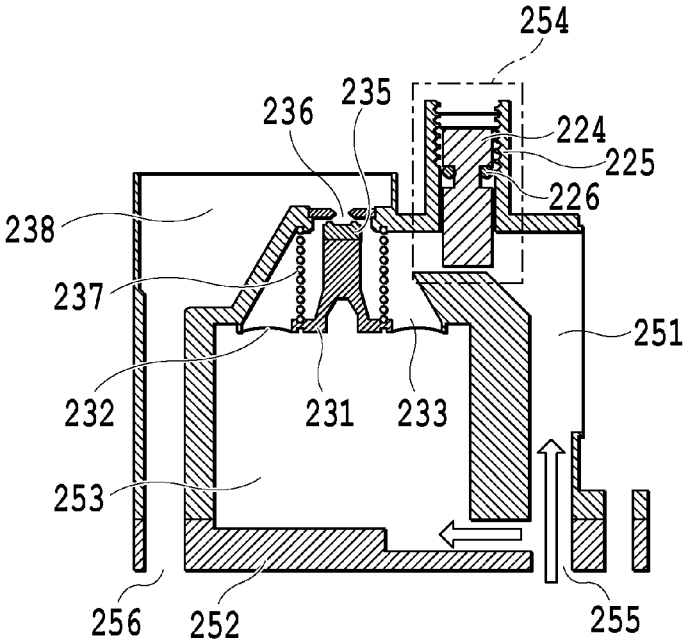
FIG. 33C is a diagram illustrating a cross section taken along XXXIIIC-XXXIIIC line of FIG. 33A.

FIG. 33A to FIG. 33C illustrate an example of a configuration of the constant flow valve mechanism according to Modified Examples 5 and 6. The invention is not restricted this configuration, and it is possible to use a mechanism including various other "constant flow valves" or "flowmatic valves". FIG. 33A illustrates an external appearance of the constant flow valve mechanism in Modified Examples 5 and 6, and FIG. 33B is a perspective view of FIG. 33A seen from below in a state in which a branching plate 252 is removed. FIG. 33C is a cross-sectional view taken along XXXIIIC-XXXIIIC line of FIG. 33A, and an arrow indicates a flow of print liquid. Print liquid entering from an inlet 255 of a constant flow valve mechanism 250 branches into a flow directed to a throttle portion 254 and a flow directed to a third pressure chamber 253 inside the branching plate 252. Print liquid passing through the throttle portion 254 is guided into a first pressure chamber, and then flows to an outlet 256 by passing through an orifice 236 and a second pressure chamber 238 in order.

A pressure plate 231, an urging member 237, a valve 235, the orifice 236, and a flexible film 232 in the first pressure chamber 233 and the second pressure chamber 238 may preferably have the same disposition and materials as those in the pressure adjustment unit (back pressure valve) illustrated in FIGS. 16A to 16C. In addition, it is possible to use a design in which a relation between a flow resistance R and a valve opening degree of the valve 235 similarly corresponds to the relation illustrated in FIG. 15. As illustrated in FIG. 33C, a gap between the orifice 236 and the valve 235 enlarges when, for example, the pressure plate 231 moves upward due to a change in differential pressure of the first pressure chamber 233 and the third pressure chamber 253. In addition, the pressure plate 231 and the valve 235 are urged by the urging member 237 corresponding to a spring member in a direction in which the valve 235 is opened.

The throttle portion 254 includes a female screw portion 225, an adjustment bolt 224, and a seal member 226 of a body 251 to be able to vary a flow resistance between the inlet 255 and the first pressure chamber 233, and a controlled flow amount of the constant flow valve mechanism may be set or varied by adjusting the flow resistance. The throttle portion 254 in the present embodiment is configured to be able to vary the flow resistance. However, another mode may be applied when a desired flow amount is fixed. In other words, a shape of the throttle portion 254 may be changed when a fixed flow resistance corresponding to the desired flow amount may be obtained between the inlet 255 and the first pressure chamber 233. For example, the throttle portion 254 may correspond to a simple orifice or the entire passage between the outlet 256 and the first pressure chamber 233. In addition, it is possible to adopt a configuration in which a flow resistance generation component designed for each type of print liquid is inserted in a replaceable manner when viscosity varies according to a color or a type of print liquid.

The third pressure chamber 253 is disposed to be fluidly separated from and adjacent to the first pressure chamber 233 by the pressure plate 231 and the flexible film 232 inside the branching plate 252, and fluidly communicates with a passage inside the branching plate positioned at an upstream of the throttle portion 254.

Next, a description will be given of a mechanism of flow amount control. A pressure inside the first pressure chamber 233 is determined based on a formula below that indicates a balance of a force related to the pressure plate 231.

$$P1=P3-(P2Sv+Kx)/Sd \quad \text{(Expression 3)}$$

Herein, values indicated by respective parameters are as below.

Sd: area of pressure plate
Sv: pressure receiving area of valve
P3: pressure inside third pressure chamber
P1: pressure inside first pressure chamber
P2: pressure inside second pressure chamber
K: spring constant of urging member 237
x: displacement of urging member 237 (spring)

When (Expression 3) is transformed, $$P3-P1=(P2Sv+Kx)/Sd \quad \text{(Expression 4)}$$

In addition, when a flow resistance of the valve 235 is set to R, and a flow amount passing through the inside of the constant flow valve mechanism 250 is set to Q, an equation below is satisfied.

$$P1=P2+QR \quad \text{(Expression 5)}$$

Herein, for example, the flow resistance R of the valve and the valve opening degree are designed to have the relation illustrated in FIG. 15. In other words, the flow resistance R is varied such that the flow resistance R decreases as the valve opening degree of the valve increases (decreases) (the flow resistance R increases when an opening and closing degree of the valve decreases). P1 is derived when a position of the valve 235 is determined such that Expression 4 and Expression 5 are simultaneously satisfied.

When P2 decreases, a force of opening the valve 235 is weakened. Therefore, the pressure plate 231 moves upward in FIG. 33C, and thus a length of the urging member 237 decreases, x corresponding to displacement from a free length increases, and a force kx of the urging member 237 increases. Inversely, when P2 increases, kx decreases. For this reason, cancellation effect acts on a variation of P2 at all times inside the round brackets in a right side of Expression 4. When values of the spring constant K of the urging member 237, the area Sd of the pressure plate, and the pressure receiving area Sv of the valve are designed such that the cancellation effect is sufficiently exhibited, a variation of (P3−P1) with respect to a variation of P3 may be made sufficiently small.

The pressure plate 231 moves upward in FIG. 33C when P3 increases. Therefore, the valve opening degree decreases, and thus a valve resistance R increases. As a result, P1 increases as can be understood from Expression 5. Inversely, P1 decreases when P3 decreases. The force kx of the urging member 237 increases (decreases) when P3 increases (decreases). Therefore, when values of the spring constant K of the urging member 237 and the area Sd of the pressure plate are designed such that, even though P3−P1 increases (decreases) from Expression 4, this variation is sufficiently made small, a variation of (P3−P1) with respect to a variation of P3 may be made sufficiently small.

As described in the foregoing, the constant flow valve mechanism 250 is designed such that a variation of a differential pressure between the internal pressure P3 of the third pressure chamber and the internal pressure P1 of the first pressure chamber is small and nearly constant with respect to pressure variations at an upstream and a downstream thereof. Since any flow is not present inside the third pressure chamber, P3 may be approximately regarded as a pressure before the throttle portion 254. Thus, a nearly constant differential pressure between P3 and P1 means that the flow amount Q is maintained nearly constant as long as the flow resistance of the throttle portion 254 and viscosity of print liquid are constant.

A more specific operation inside the constant flow valve mechanism may be described as below. For example, when a pressure at an upstream of the constant flow valve mechanism instantaneously decreases, a pressure difference in the throttle portion 254 decreases, and thus the flow amount Q instantaneously decreases. However, at the same time, the internal pressure P3 of the third pressure chamber decreases. Then, the pressure plate 231 moves downward in FIG. 33C, and the valve opening degree increases. Thus, the flow resistance R decreases, and the flow amount Q recovers. In addition, for example, the internal pressure P1 of the first pressure chamber decreases due to pressure loss of the throttle portion 254 when the flow amount Q entering from the inlet of the constant flow valve mechanism instantaneously increases. Then, the pressure plate 231 moves upward in FIG. 33C, and the valve opening degree decreases. Thus, the valve flow resistance R instantaneously increases. For this reason, a flow amount flowing out of the constant flow valve mechanism does not increase. In an inverse case, an inverse action is generated, and thus the flow amount Q is maintained constant.

Viscosity of print liquid may not be constant at all times. For example, the viscosity varies due to a temperature change, concentration resulting from water evaporation over a long period of time from the whole of the inside of the circulation system, etc. For this reason, even in the constant flow valve mechanism, an actual flow amount slightly varies according to a change in viscosity. In an actual design, paying attention is required such that the variation of the flow amount falls within a range in which image quality of printed matter is not affected.

According to the invention, a high-definition image may be printed in a circulation-type liquid ejection apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-002943, filed Jan. 8, 2016, and No. 2016-242636 filed Dec. 14, 2016, which are hereby incorporated by reference wherein in their entirety.

What is claimed is:

1. A liquid ejection apparatus comprising:

a liquid storage container that stores liquid;

a circulation mechanism that circulates liquid in a circulation path;

a liquid ejection head fluidly-connected to the liquid storage container, the liquid ejection head having a plurality of ejection openings, wherein the liquid ejection head includes at least a pair of common passages and a plurality of individual passages that connect one of the pair of common passages to the other one of the pair of common passages and communicate with the plurality of ejection openings, respectively, and at least a pair of pressure adjustment mechanisms whose pressures are set to different control pressures is connected to respective upstream sides or downstream sides of the pair of common passages.

2. The liquid ejection apparatus according to claim 1, wherein the circulation mechanism is connected to end portion sides on opposite sides from one end sides, to which the pressure adjustment mechanisms are connected, in the pair of respective common passages.

3. The liquid ejection apparatus according to claim 2, wherein the circulation mechanism includes at least a pair of circulation pumps, and the pair of circulation pumps is connected to the end portion sides on the opposite sides in the pair of respective common passages.

4. The liquid ejection apparatus according to claim 1, wherein the circulation mechanism includes at least one circulation pump.

5. The liquid ejection apparatus according to claim 1, further comprising a flow amount sensor that measures a flow amount of liquid or a temperature sensor that measures a temperature of liquid, wherein the circulation mechanism includes a circulation pump that controls the flow amount based on information from the flow amount sensor or the temperature sensor.

6. The liquid ejection apparatus according to claim 1, wherein the pressure adjustment mechanisms includes at least one constant flow valve mechanism.

7. The liquid ejection apparatus according to claim 6, wherein the constant flow valve mechanism includes a first pressure chamber that holds liquid, a second pressure chamber provided at a downstream side of the first pressure chamber, a throttle portion provided at an upstream side of the first pressure chamber, a third pressure chamber provided at an upstream side of the throttle portion, an orifice provided in a connecting portion between the first pressure chamber and the second pressure chamber, a valve provided inside the first pressure chamber to vary a flow resistance between the first pressure chamber and the second pressure chamber, an urging member that urges the valve in a direction in which a gap between the orifice and the valve is opened, a pressure plate shifted according to an increase or decrease of a pressure difference of print liquid inside the first pressure chamber and the third pressure chamber, and a flexible member joined to the pressure plate to fluidly seal the first pressure chamber, and the pressure plate delivers the shift to the valve, and the valve adjusts the gap between the orifice and the valve based on the shift, and varies the flow resistance between the first pressure chamber and the second pressure chamber.

8. The liquid ejection apparatus according to claim 1, wherein the pair of pressure adjustment mechanisms is a pair of pressure reducing-type pressure adjustment valve mechanisms that adjusts pressures in the pair of common passages connected to a downstream side of the pair of pressure adjustment mechanisms to the different control pressures, respectively.

9. The liquid ejection apparatus according to claim 8, wherein the pressure reducing-type pressure adjustment valve mechanisms include a first pressure chamber provided at a downstream side to which the liquid ejection head is connected, a second pressure chamber provided at a downstream side of the first pressure chamber, an orifice provided in a connecting portion between the first pressure chamber and the second pressure chamber, a valve provided inside the second pressure chamber to vary a flow resistance between the first pressure chamber and the second pressure chamber, an urging member that urges the valve in a direction in which a gap between the orifice and the valve is blocked, a pressure plate shifted depending on an increase or decrease in print liquid inside the second pressure chamber, and a flexible member joined to the pressure plate to fluidly seal the second pressure chamber, and the pressure plate delivers the shift to the valve, and the valve adjusts the gap between the orifice and the valve based on the shift, and varies the flow resistance between the first pressure chamber and the second pressure chamber.

10. The liquid ejection apparatus according to claim 1, wherein the pair of pressure adjustment mechanisms is a pair of back pressure-type pressure adjustment valve mechanism that adjusts pressures in the pair of common passages connected to an upstream side of the pair of pressure adjustment mechanisms to the different control pressures, respectively.

11. The liquid ejection apparatus according to claim 10, wherein the back pressure-type pressure adjustment valve mechanisms include a first pressure chamber provided at an upstream side to which the liquid ejection head is connected, a second pressure chamber provided at a downstream of the first pressure chamber, an orifice provided at a boundary between the first pressure chamber and the second pressure chamber, a valve provided inside the first pressure chamber to vary a flow resistance between the first pressure chamber and the second pressure chamber, an urging member that urges the valve in a direction in which a gap between the orifice and the valve is opened, a pressure plate shifted depending on an increase or decrease in print liquid inside the first pressure chamber, and a flexible member joined to the pressure plate to fluidly seal the first pressure chamber, and the pressure plate delivers the shift to the valve, and the valve adjusts the gap between the orifice and the valve based on the shift, and varies the flow resistance between the first pressure chamber and the second pressure chamber.

12. The liquid ejection apparatus according to claim 1, wherein the one of the pair of common passages is controlled to have a positive pressure, and the other one of the pair of common passages is controlled to have a negative pressure.

13. The liquid ejection apparatus according to claim 1, wherein a set pressure of one of the pair of pressure adjustment mechanisms is set such that internal pressures of the common passages connected to the pressure adjustment mechanisms become positive pressures, and a set pressure of the other one of the pair of pressure adjustment mechanisms is set such that internal pressures of the common passages connected to the pressure adjustment mechanisms become negative pressures.

14. The liquid ejection apparatus according to claim 1, the liquid ejection head further comprising a plurality of print element boards, each of which includes the ejection openings, a print element generating energy for ejecting liquid, and a pressure chamber that includes the print element therein, wherein the pair of common passages communicates with the plurality of print element boards.

15. The liquid ejection apparatus according to claim 14, wherein the pair of common passages includes a common supply passage that supplies the liquid to the plurality of print element boards and a common collection passage that collects the liquid from the plurality of print element boards.

16. The liquid ejection apparatus according to claim 15, wherein the plurality of individual passages include an individual supply passage for supplying the liquid from the common supply passage to the plurality of print element boards and an individual collection passage for collecting the liquid from the plurality of print element boards to the common collection passage.

17. A liquid ejection head used for a liquid ejection apparatus including a liquid storage container that stores liquid, a circulation mechanism that circulates the liquid in a circulation path, the liquid ejection head comprising:

a plurality of print element boards, each of which includes an ejection opening, a print element generating energy for ejecting liquid, a pressure chamber that includes the print element therein;

a pair of common passages communicating with the plurality of print element boards;

a plurality of individual passages that connect one of the pair of common passages to the other one of the pair of common passages and communicate with the plurality of pressure chambers, respectively; and a pair of pressure adjustment mechanisms, pressures of which are set to be different from each other, connected to respective upstream sides or downstream sides of the pair of common passages.

18. The liquid ejection head according to claim 17, further comprising a passage member including a pair of passage members, wherein the plurality of print element boards are arranged in a straight line shape in the passage member.

19. The liquid ejection head according to claim 17, wherein liquid inside the pressure chamber is circulated between an inside and an outside of the pressure chamber.

20. The liquid ejection apparatus according to claim 17, wherein the pair of common passages includes a common supply passage that supplies the liquid to the plurality of print element boards and a common collection passage that collects the liquid from the plurality of print element boards, and the plurality of individual passages include an individual supply passage for supplying the liquid from the common supply passage to the plurality of print element boards and an individual collection passage for collecting the liquid from the plurality of print element boards to the common collection passage.

* * * * *